US009834736B2

(12) United States Patent
Fujiwara et al.

(10) Patent No.: US 9,834,736 B2
(45) Date of Patent: Dec. 5, 2017

(54) LUBRICATING OIL COMPOSITION FOR INTERNAL COMBUSTION ENGINES OF PASSENGER AND COMMERCIAL FOUR-WHEELED VEHICLES

(71) Applicants: FUJIFILM Corporation, Tokyo (JP); TOYOTA JIDOSHA KABUSHIKI KAISHA, Toyota-shi, Aichi-ken (JP)

(72) Inventors: Toshiki Fujiwara, Kanagawa (JP); Hiroyuki Suzuki, Kanagawa (JP); Saisuke Watanabe, Kanagawa (JP); Ippei Fukutomi, Toyota (JP); Motoichi Murakami, Toyota (JP); Tetsushi Suzuki, Toyota (JP)

(73) Assignees: FUJIFILM Corporation, Tokyo (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 15/183,062

(22) Filed: Jun. 15, 2016

(65) Prior Publication Data

US 2016/0289591 A1 Oct. 6, 2016

Related U.S. Application Data

(63) Continuation of application No. PCT/JP2014/083026, filed on Dec. 12, 2014.

(30) Foreign Application Priority Data

Dec. 16, 2013 (JP) ..... 2013-259142
Jul. 28, 2014 (JP) ..... 2014-152928

(51) Int. Cl.
*C10M 169/04* (2006.01)

(52) U.S. Cl.
CPC .... *C10M 169/041* (2013.01); *C10M 169/044* (2013.01); *C10M 2203/024* (2013.01);
(Continued)

(58) Field of Classification Search
CPC combination set(s) only.
See application file for complete search history.

(56) References Cited

U.S. PATENT DOCUMENTS 4,098,705 A 7/1978 Sakurai et al.
4,789,492 A 12/1988 Katsumata et al.
(Continued)

FOREIGN PATENT DOCUMENTS

JP 61-106587 A 5/1986
JP 2003-252887 A 9/2003
(Continued)

OTHER PUBLICATIONS

API technical bulletin JAPI J 1509 Eolcs 16th Edition, Jun. 17, 2010, 39 pages.
(Continued)

*Primary Examiner* — Taiwo Oladapo
(74) *Attorney, Agent, or Firm* — Sughrue Mion, PLLC

(57) ABSTRACT

A lubricating oil composition for internal combustion engines of passenger and commercial four-wheeled vehicles is provided which can exhibit excellent fuel efficiency performance and wear resistance reliability. The lubricating oil composition includes a base oil and a complex polyester mixture. The base oil includes at least one of poly-α-olefin, an ester-based base oil, or a partially hydrogenated mineral oil. The complex polyester mixture includes a polyester obtained by condensing a polyhydric alcohol, a polycarboxylic acid, and a monohydric alcohol having an oxyalkylene group. The content of the complex polyester mixture is 0.01% by mass or more with respect to the total mass of the
(Continued)

lubricating oil composition, the high-temperature shear viscosity (HTHS viscosity) at 150° C. is 1.0 mPa·s to 2.6 mPa·s, and the NOACK evaporation amount is 40% or less.

12 Claims, 4 Drawing Sheets

(52) U.S. Cl.
CPC ..... *C10M 2203/1006* (2013.01); *C10M 2205/0285* (2013.01); *C10M 2207/2805* (2013.01); *C10M 2207/2835* (2013.01); *C10M 2209/102* (2013.01); *C10M 2209/11* (2013.01); *C10M 2209/111* (2013.01); *C10M 2219/068* (2013.01); *C10M 2223/043* (2013.01); *C10M 2223/045* (2013.01); *C10M 2223/047* (2013.01); *C10N 2210/02* (2013.01); *C10N 2210/06* (2013.01); *C10N 2220/022* (2013.01); *C10N 2230/02* (2013.01); *C10N 2230/06* (2013.01); *C10N 2230/08* (2013.01); *C10N 2230/54* (2013.01); *C10N 2230/68* (2013.01); *C10N 2230/74* (2013.01); *C10N 2240/10* (2013.01); *C10N 2260/02* (2013.01)

(56) References Cited

U.S. PATENT DOCUMENTS 6,844,301 B2 * 1/2005 Field ..... C10M 105/38 508/485
7,399,736 B2 7/2008 Marumo et al.
9,255,058 B2 2/2016 Kawata et al.
2005/0221998 A1 * 10/2005 Marumo ..... C10M 161/00 508/371
2012/0184474 A1 * 7/2012 Kawata ..... C07C 67/08 508/497

FOREIGN PATENT DOCUMENTS

JP 2005-041998 A 2/2005
JP 2009-221330 A 10/2009
JP 2010-095665 A 4/2010
JP 2013-060533 A 4/2013
JP 2013-170217 A 9/2013
WO 98/10039 A1 3/1998
WO 98/10040 A1 3/1998
WO 98/10041 A1 3/1998
WO 98/10043 A1 3/1998
WO 2011/007643 A1 1/2011
WO 2011/037217 A1 3/2011

OTHER PUBLICATIONS

International Preliminary Report on Patentability of PCT/JP2014/083026 dated Jan. 7, 2015.
English Translation of International Preliminary Report on Patentability dated Jun. 16, 2016, issued by the International Searching Authority in Application No. PCT/JP2014/083026.
Extended European Search Report dated Dec. 16, 2016 from the European Patent Office in counterpart European Application No. 14871184.9.
Office Action dated Jun. 6, 2017, from the Japanese Patent Office in counterpart Japanese Application No. 2014-152928.

* cited by examiner

LUBRICATING OIL COMPOSITION FOR INTERNAL COMBUSTION ENGINES OF PASSENGER AND COMMERCIAL FOUR-WHEELED VEHICLES

CROSS-REFERENCE TO RELATED APPLICATIONS

This application is a Continuation of PCT International Application No. PCT/JP2014/083026, filed on Dec. 12, 2014, which claims priority under 35 U.S.C. Section 119(a) to Japanese Patent Application No. 2013-259142 filed on Dec. 16, 2013 and Japanese Patent Application No. 2014-152928 filed on Jul. 28, 2014. Each of the above applications is hereby expressly incorporated by reference, in its entirety, into the present application.

BACKGROUND OF THE INVENTION

1. Field of the Invention

The present invention relates to a lubricating oil composition for internal combustion engines. Specifically, the present invention relates to a lubricating oil composition for internal combustion engines which is a lubricating oil composition for internal combustion engines of passenger and commercial four-wheeled vehicles and includes a base oil having a low viscosity and a specific complex polyester mixture.

2. Description of the Related Art

In general, a lubricating oil composition for internal combustion engines includes a base oil and various additives. As the base oil, mineral oils to be obtained from crude oil, and ester-based oils, fluorine oils, poly-α-olefin-based oils and the like to be chemically synthesized are generally used.

There are many quality standards for a lubricating oil composition used for internal combustion engines of vehicles such as four-wheeled vehicles from the viewpoint of durability and environmental protection. Among these, in the quality standards of gasoline engine oils for vehicles established by International Lubricants Standardization and Approval Committee (ILSAC), in consideration of influences on engine components, various oil standards are established. Among these, regarding wear resistance reliability, there is an item which restricts design of engine components and a base oil which does not meet the standards regarding wear resistance reliability cannot be used as a base oil of a lubricating oil composition for internal combustion engines of vehicles and the like.

In recent years, there has been a problem of improving fuel efficiency of vehicles from the viewpoint of environmental protection. In order to improve fuel efficiency of vehicles, there is a method of improving the fuel efficiency performance of an engine oil. In order to improve the fuel efficiency performance of an engine oil, it is important to lower the viscosity of the base oil. However, in the case of lowering the viscosity of the base oil, there may be an adverse influence on boundary lubrication and wear may be accelerated. Therefore, in order to prevent wear, it has been considered to add various load resistant additives such as an oily agent, an anti-wear agent and an extreme pressure additive. For example, in WO2011/007643A and JP2013-060533A, it is proposed that high wear resistance can be exhibited by adding an additive such as an organic metal compound to a base oil.

SUMMARY OF THE INVENTION

As described above, the wear resistance reliability of the lubricating oil compositions can be enhanced to a certain degree by adding a specific additive to the base oil. However, the wear resistance reliability of these lubricating oil compositions is not sufficient and a lubricating oil composition having further enhanced fuel efficiency performance and wear resistance reliability has been demanded.

In order to solve the problems of the related art, the present inventors have conducted studies to provide a lubricating oil composition which is a lubricating oil composition used for internal combustion engines of passenger and commercial four-wheeled vehicles and can exhibit excellent fuel efficiency performance and wear resistance reliability.

As a result of intensive studies conducted to solve the above problems, the present inventors have found that the fuel efficiency performance and the wear resistance reliability of a lubricating oil composition for internal combustion engines of passenger and commercial four-wheeled vehicles obtained by adding a specific complex polyester mixture to a base oil can be enhanced by setting the high-temperature shear viscosity (HTHS viscosity) of the lubricating oil composition at 150° C. to 1.0 mPa·s to 2.6 mPa·s and setting the NOACK evaporation amount to 40% or less. Here, the specific complex polyester mixture includes a polyester obtained by condensing a polyhydric alcohol having at least two hydroxyl groups, a polycarboxylic acid including at least two carboxyl groups, and a monohydric alcohol having at least one oxyalkylene group.

Specifically, the present invention has the following constitutions.

[1] A lubricating oil composition for internal combustion engines of passenger and commercial four-wheeled vehicles comprising a base oil, and a complex polyester mixture, in which the base oil includes at least one of poly-α-olefin, an ester-based base oil, or a partially hydrogenated mineral oil, the complex polyester mixture includes a polyester obtained by condensing a polyhydric alcohol having at least two hydroxyl groups, a polycarboxylic acid including at least two carboxyl groups, and a monohydric alcohol having at least one oxyalkylene group, the content of the complex polyester mixture is 0.01% by mass or more with respect to the total mass of the lubricating oil composition for internal combustion engines, the HTHS viscosity of the lubricating oil composition for internal combustion engines, which is high-temperature shear viscosity at 150° C., is 1.0 mPa·s to 2.6 mPa·s, and the NOACK evaporation amount is 40% or less.

[2] The lubricating oil composition for internal combustion engines according to [1], in which the content of the complex polyester mixture is 0.01% by mass to 20% by mass with respect to the total mass of the lubricating oil composition for internal combustion engines.

[3] The lubricating oil composition for internal combustion engines according to [1] or [2], in which the number of carbon atoms in the polycarboxylic acid is 7 or more and the number of carbon atoms in the monohydric alcohol is 3 or more.

[4] The lubricating oil composition for internal combustion engines according to any one of [1] to [3], in which the polyhydric alcohol includes three or more hydroxyl groups.

[5] The lubricating oil composition for internal combustion engines according to any one of [1] to [4], in which the polyhydric alcohol is selected from pentaerythritol, trimethylolpropane, glycerin and dipentaerythritol.

[6] The lubricating oil composition for internal combustion engines according to any one of [1] to [5], in which the number of carbon atoms in the polycarboxylic acid is 24 to 54.

[7] The lubricating oil composition for internal combustion engines according to any one of [1] to [6], in which the number of carbons in the monohydric alcohol is 6 or more.

[8] The lubricating oil composition for internal combustion engines according to any one of [1] to [7], in which the monohydric alcohol is represented by the following Formula (1):

$$R^a\text{-}(\text{-}O(CX^{a1}X^{a2})_{na1}\text{-})_{na2}OH \qquad \text{Formula (1)}$$

in the Formula (1), $R^a$ represents an alkyl group which may have a substituent, a cycloalkyl group which may have a substituent, an alkenyl group which may have a substituent, an aryl group which may have a substituent, or a heteroaryl group which may have a substituent, $X^{a1}$ and $X^{a2}$ each independently represent a hydrogen atom, a halogen atom, or an alkyl group, na1 represents an integer of 1 to 4, na2 represents an integer of 1 to 12, in the case in which na1 is 2 or greater, na1 $X^{a1}$s may be the same or different from each other, na1 $X^{a2}$s may be the same or different from each other, and in the case in which na2 is 2 or greater, na2 —$O(CX^{a1}X^{a2})_{na1}$-s may be the same or different from each other.

[9] The lubricating oil composition for internal combustion engines according to any one of [1] to [8], in which the polyester is obtained by mixing the polycarboxylic acid, the polyhydric alcohol, and the monohydric alcohol such that the molar ratio of the polycarboxylic acid is 1 to 5 and the molar ratio of the monohydric alcohol is 0.5 to 5 with respect to the polyhydric alcohol and condensing the mixture.

[10] The lubricating oil composition for internal combustion engines according to any one of [1] to [9], in which the polyester is obtained by mixing the polycarboxylic acid, the polyhydric alcohol, and the monohydric alcohol such that the molar ratio of the polycarboxylic acid is 2.2 to 5 and the molar ratio of the monohydric alcohol is 2.5 to 5 with respect to the polyhydric alcohol and condensing the mixture.

[11] The lubricating oil composition for internal combustion engines according to any one of [1] to [10], in which the monohydric alcohol is represented by the following Formula (1-1):

$$C_xH_{2x+1}\text{—}\underset{}{\overset{C_yH_{2y+1}}{\overset{|}{CH}}}\text{—}CH_2\text{—}(OC_zH_{2z})_p\text{—}OH \qquad \text{Formula (1-1)}$$

in the Formula (1-1), x represents an integer of 4 to 9, y represents an integer of 2 to 9, z represents 2 or 3, p represents 1 or 2, and in the case in which p is 2 or greater, p —$(OC_zH_{2z})$-s may be the same or different from each other.

[12] The lubricating oil composition for internal combustion engines according to any one of [1] to [11], further comprising an organic metal compound, in which the content of the organic metal compound is 0.001% by mass to 0.4% by mass with respect to the lubricating oil composition for internal combustion engines.

According to the present invention, it is possible to obtain a lubricating oil composition for internal combustion engines of passenger and commercial four-wheeled vehicles that can exhibit excellent fuel efficiency performance and wear resistance reliability. In addition, since the lubricating oil composition for internal combustion engines of the present invention has high wear resistance reliability, the degree of freedom in engine design can be remarkably improved.

DESCRIPTION OF THE PREFERRED EMBODIMENTS

Figure 1:
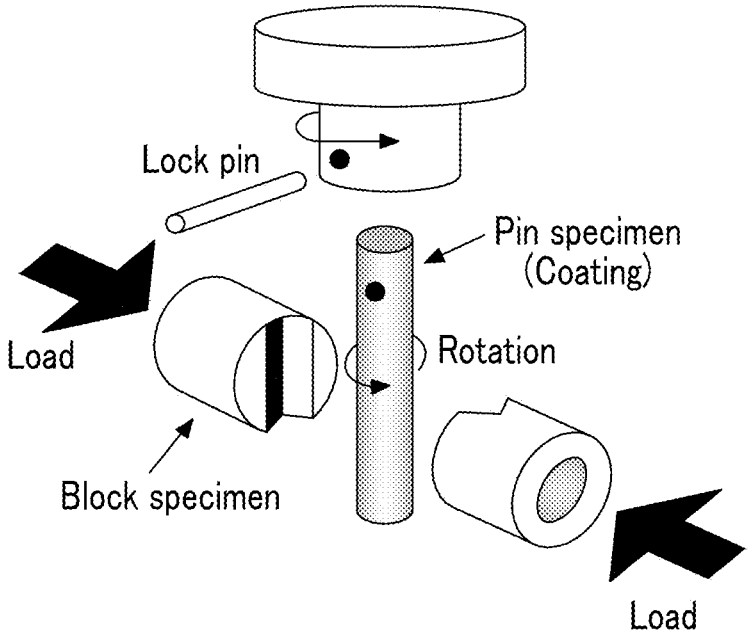
FIG. 1 is a view showing a Falex wear test evaluation apparatus according to ASTM D 2670.

Hereinafter, the present invention will be described in detail. The description of the constitution requirements to be described below is occasionally made on the basis of representative embodiments and specific examples of the present invention, but the present invention is not limited thereto. The numerical range represented by the term "to" in the specification include the numerical values set forth before and after "to" as lower and upper limits, respectively.

(Lubricating Oil Composition for Internal Combustion Engines)

A lubricating oil composition for internal combustion engines of the present invention is a lubricating oil composition used for internal combustion engines to be mounted on passenger and commercial four-wheeled vehicles and includes a base oil and a complex polyester mixture. The base oil includes at least one of poly-α-olefin, an ester-based base oil, or a partially hydrogenated mineral oil and the complex polyester mixture includes a polyester obtained by condensing a polyhydric alcohol having at least two hydroxyl groups, a polycarboxylic acid including at least two carboxyl groups, and a monohydric alcohol having at least one oxyalkylene group. The content of the complex polyester mixture is 0.01% by mass or more with respect to the total mass of the lubricating oil composition for internal combustion engines, the high temperature shear viscosity (HTHS viscosity) of the lubricating oil composition at 150° C. is 1.0 mPa·s to 2.6 mPa·s, and the NOACK evaporation amount is 40% or less.

As described above, the lubricating oil composition for internal combustion engines of the present invention can exhibit high fuel efficiency performance and wear resistance performance by adding a complex polyester mixture including a specific polyester to a low viscosity base oil. The complex polyester mixture is a lubricant and has a function of enhancing the lubricating performance of the lubricating oil composition for internal combustion engines.

In the present invention, since wear resistance reliability can be secured even in a low viscosity base oil or an ultra low viscosity base oil, both high fuel efficiency performance and high wear resistance performance can be obtained. In this manner, the lubricating oil composition for internal combustion engines of the present invention is a completely new lubricating oil composition capable of exhibiting wear resistance performance in a region in which the high temperature shear viscosity (HTHS viscosity) of the lubricating oil composition at 150° C. is very low.

In addition, the lubricating oil composition for internal combustion engines of the present invention can be preferably used as a lubricating oil composition for internal combustion engines since the evaporativity of the base oil is suppressed.

Preferable representative examples of the passenger and commercial four-wheeled vehicles include small passenger and commercial vehicles whose displacement amount is 500 cc to 1,000 cc and passenger and commercial vehicles whose displacement amount is 1,000 cc to 7,000 cc.

The content of the complex polyester mixture may be 0.01% by mass or more and is preferably 0.1% by mass to 20% by mass, and more preferably 0.1% by mass to 2.5% by mass with respect to the total mass of the lubricating oil composition for internal combustion engines. In addition, from the viewpoint of the amount of reduction in wear, the content is preferably 0.25% by mass to 2.5% by mass and more preferably 0.5% by mass to 2.5% by mass. From the viewpoint of obtaining both reduction in wear and high fuel efficiency, the content is still more preferably 0.25% by mass to 1.0% by mass and particularly preferably 0.5% by mass to 1.0% by mass. By setting the content of the complex polyester mixture to be in the above range, it is possible to more effectively enhance the wear resistance performance.

The high temperature shear viscosity (HTHS viscosity) of the lubricating oil composition at 150° C. may be 1.0 mPa·s to 2.6 mPa·s and is preferably 1.2 mPa·s to 2.3 mPa·s and more preferably 1.5 mPa·s to 2.3 mPa·s. Here, the HTHS viscosity is the viscosity lowered under a high temperature shear condition and refers to the effective viscosity at a high temperature high speed sliding surface.

In the related art, as the HTHS viscosity becomes higher, the amount of wear at the sliding surface becomes smaller. However, the viscosity resistance increases, which causes a problem of deterioration in fuel efficiency. The lower HTHS viscosity contributes to fuel saving. However, it has been known that if the viscosity is lower than 2.6 mPa·s, the amount of wear drastically increases and thus it is not possible to put a base oil having a viscosity lower than 2.6 mPa·s into a practical use for a lubricating oil composition for internal combustion engines of passenger and commercial four-wheeled vehicles. However, in the present invention, as described above, by adding a specific complex polyester mixture, wear resistance is enhanced while lowering the HTHS viscosity and the fuel efficiency is improved.

The NOACK evaporation amount of the lubricating oil composition may be 40% or less and is preferably 30% or less and more preferably 15% or less. Here, the NOACK evaporation amount refers to an evaporation loss amount measured according to ASTM D 5800-95. By setting the NOACK evaporation amount to be in the above range, the evaporation loss amount of the base oil can be reduced and the durability and safety can be enhanced.

The value of the NOACK evaporation amount is an index for estimating the amount of the engine lubricating oil reduced during the operation of an internal combustion engine. When the viscosity of the base oil is lowered, a lubricating oil is formed by mixing various base oils having a small number of carbon atoms and thus the value of the NOACK evaporation amount rather increases. Therefore, it is important for a lubricating oil composition which satisfies a low shear viscosity of 2.6 mPa·s to reduce the evaporation loss amount and improve the reliability of an internal combustion engine. A specimen in which the value of the NOACK evaporation amount is 40% or less is used this time but the NOACK evaporation amount is preferably set to 15% or less to secure the current oil drain interval.

The lubricating oil composition may be formed by mixing various additives which are additives generally applicable in the GF-5 standards. Specifically, examples of a main additive composition may include a cleaning dispersing agent such as Ca sulfonate and the addition ratio of the cleaning dispersing agent is preferably 4,000 ppm or less, more preferably 3,000 ppm or less, and still more preferably 2,000 ppm or less.

In the case of adding organic molybdenum compounds (MoDTC, Mo amine and the like) as an additive, the addition ratio is preferably 2,000 ppm or less, more preferably 1,500 ppm or less, and still more preferably 900 ppm or less. The addition ratio of organic zinc compounds (ZnDTP and the like) is preferably 2,000 ppm or less, more preferably 1,500 ppm or less, and still more preferably 900 ppm or less.

As an extreme pressure preventing agent, there are alkyl and phenyl compounds containing phosphorus and sulfur and a state in which the extreme pressure preventing agent is added is preferable. Further, a state in which various hindered phenol-based, hindered amine-based, and phosphite oxidation preventing agents are added is preferable.

(Base Oil)

The base oil used for the lubricating oil composition for internal combustion engines of the present invention includes at least one of poly-α-olefin, an ester-based base oil, or a partially hydrogenated mineral oil. In addition, the base oil may include at least one of chemically synthesized isoparaffin-based and glycol-based base oils, and paraffin-based and naphthene-based mineral oils of partially hydrogenated mineral oils. Specifically, it is preferable for the base oil used in the present invention to use a mixture of a poly-α-olefin-based base oil with a paraffin-based base oil or a partially hydrogenated paraffin-based mineral oil. It is preferable that the mixing ratio between the paraffin-based base oil and the poly-α-olefin-based base oil is adjusted to be appropriate such that desired HTHS viscosity and NOACK evaporation amount can be obtained.

Representative examples of the poly-α-olefin-based base oil include SYNFLUIDs 201, 401, 601, 801, 2 cst, 2.5 cst, 4 cst, 5 cst, 6 cst, 7 cst, and 8 cst, produced by NIPPON STEEL & SUMIKIN CHEMICAL CO., LTD. Examples of the ester-based base oil include DIESTER, DOS, TRIESTER, POE, TMP, MPEE, and DPE, produced by HATCOL Corporation. Examples of the partially hydrogenated mineral oil include TOYOTA CASTLE oils produced by Exxon Mobil Corporation.

In addition, as the base oil, other than the above-mentioned base oils, at least one selected from a mineral oil, a fat and oil compound, a silicone oil, a perfluoropolyether oil, a phenyl ester oil, a glycol oil, and the like may be added.

In the present invention, the term "base oil" refers to a base oil generally called "flowing liquid". However, it is not necessary that the material is liquid at room temperature or at used temperature and material in any form of solid or gel, other than liquid, can be also used.

The following method is proposed as an example for preparing a mineral oil with a reduced NOACK evaporation amount.

For a representative mineral oil as the base oil, it is preferable to use a hydrocarbon-based base oil that is obtained by refining a lubricating oil component, obtained by subjecting crude oil to atmospheric distillation and/or vacuum distillation, through one refining treatment or in combination of two or more refining treatments of (1)

solvent deasphalting, (2) solvent extraction, (3) hydrocracking, (4) a dewaxing treatment such as solvent dewaxing or catalyst dewaxing, (5) hydrorefining, and (6) a refining treatment such as sulfuric acid pickling or clay treatment. For the hydrocarbon-based base oil, it is preferable to use a base oil in which a ratio ($C24_{under}/C25_{over}$) between the ratio of a component having 24 or less carbon atoms ($C24_{under}$) in a carbon number distribution obtained by gas chromatography distillation and the ratio of a component having 25 or more carbon atoms ($C25_{over}$) is 1.8 or more. The ratio $C24_{under}/C25_{over}$ is preferably 2.0 or more and more preferably 2.5 or more. By setting the ratio $C24_{under}/C25_{over}$ to be in the above range, the high temperature shear viscosity (HTHS viscosity) can be lowered.

In addition, it is preferable to use a hydrocarbon-based base oil in which a ratio $C18_{under}/C19_{over}$ between the ratio of a component having 18 or less carbon atoms ($C18_{under}$) in a carbon number distribution obtained by gas chromatography and the ratio of a component having 19 or more carbon atoms ($C19_{over}$) is 10 or less. The ratio $C18_{under}/C19_{over}$ is preferably 5 or less, more preferably 2 or less, and most preferably 1 or less. By setting the ratio $C18_{under}/C19_{over}$ to be in the above range, the amount of the lubricating oil consumed can be suppressed.

(Complex Polyester Mixture (Lubricant))

The complex polyester mixture used for the lubricating oil composition for internal combustion engines of the present invention includes a polyester obtained by condensing a polyhydric alcohol having at least two hydroxyl groups, a polycarboxylic acid including at least two carboxyl groups, and a monohydric alcohol having at least one oxyalkylene group. The complex polyester mixture is a lubricant used for the lubricating oil composition for internal combustion engines.

<Polyhydric Alcohol>

The polyhydric alcohol used for the condensation of the polyester is a compound including at least two hydroxyl groups. The polyhydric alcohol is represented by $R(OH)_n$. R represents an n-valent aliphatic, alicyclic, or aromatic ring group and one or more carbon atoms which are not adjacent to each other in R may be substituted with oxygen atoms. The number of hydroxyl groups included in one polyhydric alcohol molecule is preferably 2 to 4 and more preferably 3 or 4. That is, the polyhydric alcohol is preferably triol or tetraol.

As the polyhydric alcohol used in the present invention, any one of divalent to tetravalent polyhydric alcohols may be used and plural polyhydric alcohols may be used. For example, a mixture of a divalent polyhydric alcohol and a trivalent polyhydric alcohol may be used and a mixture of a divalent polyhydric alcohol, a trivalent polyhydric alcohol, and a tetravalent polyhydric alcohol may be used. In addition, a mixture of a trivalent polyhydric alcohol and a tetravalent polyhydric alcohol may be used. In the case of incorporating a divalent polyhydric alcohol, the content of the divalent polyhydric alcohol is preferably 40% by mass or less, more preferably 30% by mass or less, and still more preferably 20% by mass or less with respect to the total mass of the polyhydric alcohol.

R represents an n-valent aliphatic group including preferably 2 to 20 carbon atoms, more preferably 2 to 15 carbon atoms, still more preferably 2 to 10 carbon atoms, even still more preferably 2 to 7 carbon atoms, and particularly preferably 3 to 6 carbon atoms. However, the number of carbon atoms is not limited to these ranges and a large number of carbon atoms is rather preferable in some cases according to applications.

Examples of the polyhydric alcohol that can be used in the present invention include the following compounds. There are mentioned diols such as ethylene glycol, propylene glycol, 1,4-butanediol, 1,3-butanediol, 1,6-hexanediol, 1,4-dimethylolcyclohexane, and neopentyl glycol; triols such as trimethylolmethane, trimethylolethane, trimethylolpropane, trimethylolbutane, and glycerin; tetraols such as ditrimethylolpropane; maltiols such as dipentaerythritol and tripentaerythritol; sugar alcohols such as xylitol, sorbitol, mannitol, erythritol, maltitol, isomalt, arbinitol, ribitol, iditol, volemitol, and periseitol; and sugars such as glucose. Among these, neopentyl glycol, trimethylolethane, trimethylolpropane, trimethylolbutane, glycerin, pentaerythritol, dipentaerythritol, and xylitol are preferable; trimethylolpropane, trimethylolbutane, glycerin, pentaerythritol, dipentaerythritol and the like are more preferable; trimethylolpropane, glycerin, pentaerythritol, dipentaerythritol and the like are still more preferable; and pentaerythritol and trimethylolpropane are particularly preferable. These may be not necessarily high-purity products, but so-called industrial-use brands may be preferably used here. For example, an industrial-use brand of pentaerythritol is constituted by about 88% of mono-, 10% of di- and from 1 to 2% of tri-pentaerythritols; and the industrial-use brand of the pentaerythritol or the like can be used as polyhydric alcohol in the present invention.

Specific examples of the polyhydric alcohol that can be used in the present invention will be shown below. However, the present invention is not limited thereto.

PA-1

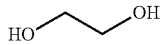

PA-2

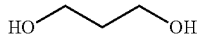

PA-3

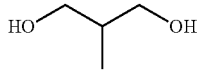

PA-4

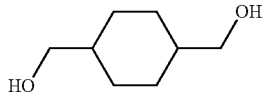

PA-5

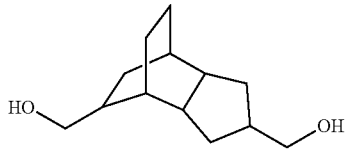

PA-6

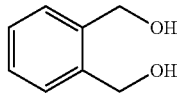

PA-7

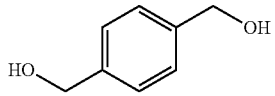

PA-8

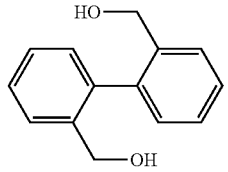

-continued

PA-9

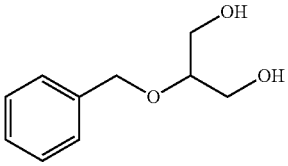

PA-10

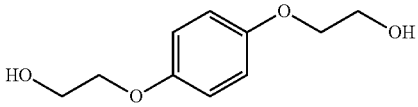

PA-11

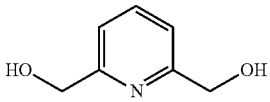

PA-12

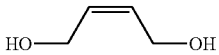

PA-13

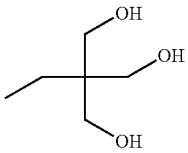

PA-14

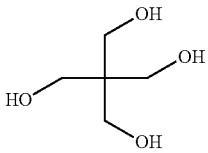

PA-15

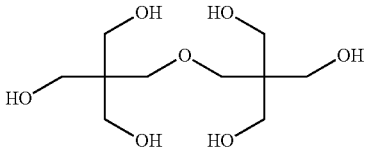

PA-16

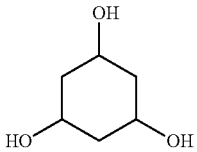

PA-17

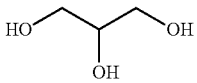

PA-18

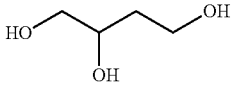

PA-19

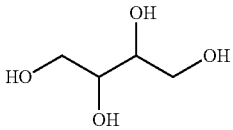

PA-20

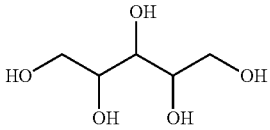

-continued

PA-21

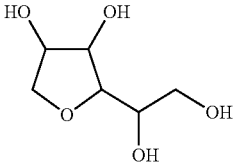

<Polycarboxylic Acid>

The polycarboxylic acid used for the condensation of the polyester is a compound including at least two carboxyl groups. The number of carboxyl groups in one molecule is preferably 2 to 4 and more preferably 2 or 3. In addition, the polycarboxylic acid is preferably dimer acid or trimer acid.

As the polycarboxylic acid used in the present invention, any one of divalent to tetravalent polycarboxylic acids may be used and plural polycarboxylic acids may be used. For example, a mixture of a divalent carboxylic acid and a trivalent carboxylic acid may be used and a mixture of a divalent carboxylic acid, a trivalent carboxylic acid, and a tetravalent carboxylic acid may be used. In addition, a mixture of a trivalent carboxylic acid and a tetravalent carboxylic acid may be used.

The number of carbon atoms in the polycarboxylic acid is preferably 7 or more, more preferably 12 or more, still more preferably 18 or more, and particularly preferably 24 or more. In addition, the number of carbon atoms in the polycarboxylic acid is preferably 66 or less, more preferably 60 or less, and still more preferably 54 or less. Among these, the number of carbon atoms in the polycarboxylic acid is particularly preferably 24 to 54. In the present invention, the number of carbon atoms in the polycarboxylic acid is the number of carbon atoms including carbon atoms constituting the carboxyl group.

By setting the number of carbon atoms in the polycarboxylic acid to be in the above range as described above, the lubricating performance of the lubricating oil composition for internal combustion engines can be further enhanced.

The carboxyl groups in the molecule are coupled by a chainlike or cyclic divalent or higher aliphatic hydrocarbon or aromatic hydrocarbon. One or more carbon atoms, which are not adjacent to each other, in the aliphatic hydrocarbon or aromatic hydrocarbon coupling group may be substituted with oxygen atoms. Among these, a group which couples the carboxyl groups in the molecule is preferably aliphatic hydrocarbon having 20 to 51 carbon atoms.

Examples of the polycarboxylic acid that can be used in the present invention include terephthalic acid, phthalic acid, malonic acid, succinic acid, glutaric acid, adipic acid, suberic acid, azelaic acid, sebasic acid, dodecanedioic acid, trimellitic acid, dimer acid, dimer acid hydrogenate, and trimer acid. Among these, dimer acid, dimer acid hydrogenate, and trimer acid are preferably used.

Here, the dimer acid refers to aliphatic or alicyclic dicarboxylic acids formed by dimerization of unsaturated fatty acid (typically having 18 carbon atoms) through polymerization, a Diels-Alder reaction, or the like (mostly containing several percents by mole of a trimer, a monomer, and the like other than most dimmers) and among these, an acid having a trimer as a main component is defined as a trimer acid.

Regarding specific examples of the dimer acid and the trimer acid, TSUNODIME (registered trademark) 205, 216, 228, and 395, produced by TSUNO CO., LTD, can be mentioned as examples of the dimer acid and TSUNODIME 345 and the like can be mentioned as examples of the trimer acid. Additionally, examples thereof also include products produced by Cognis Ip Man Gmbh and Unichema International.

In the present invention, instead of the polycarboxylic acid, an anhydride of the polycarboxylic acid can be used. The anhydride of the polycarboxylic acid is a product produced through intramolecular or intermolecular dehydrating condensation of two COOHs in the above-mentioned polycarboxylic acid. Preferable embodiments of the anhydride are the same as mentioned above. Examples of the anhydride include succinic anhydride, glutaric anhydride, adipic anhydride, maleic anhydride, phthalic anhydride, nadic anhydride, methylnadic anhydride, hexahydrophthalic anhydride, and mixed polybasic acid anhydrides.

Specific examples of the polycarboxylic acid that can be used in the present invention will be shown below. However, the present invention is not limited thereto.

CA-1

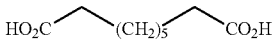

CA-2

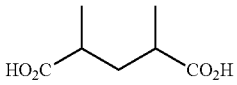

CA-3

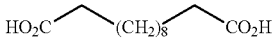

CA-4

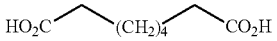

CA-5

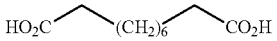

CA-6

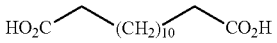

CA-7

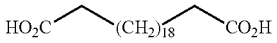

CA-8

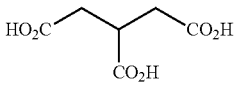

CA-9

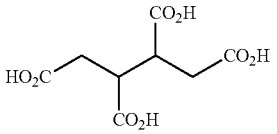

CA-10

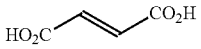

CA-11

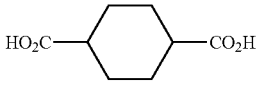

CA-12

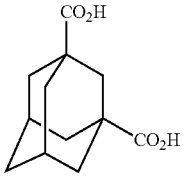

-continued

CA-13

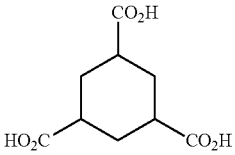

CA-14

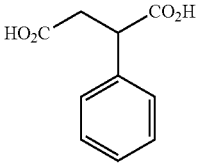

CA-15

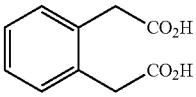

CA-16

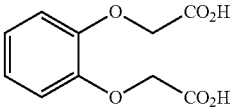

CA-17

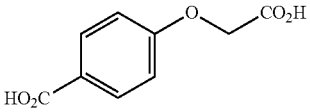

CA-18

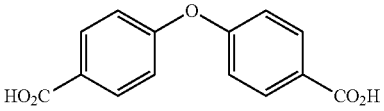

CA-19

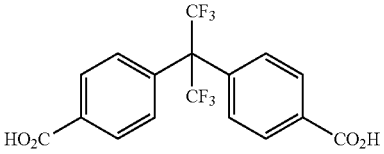

CA-20

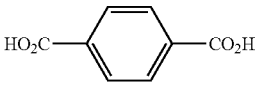

CA-21

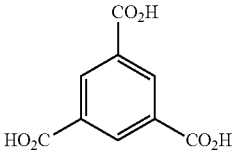

CA-22

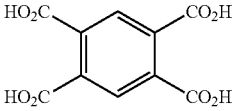

CA-23

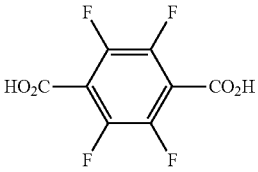

-continued

CA-24

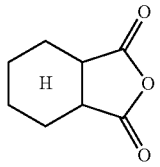

CA-25

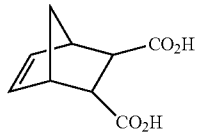

CA-26

$C_{34}H_{62}(COOH)_2$
Dimer acid

CA-27

$C_{51}H_{93}(COOH)_3$
Trimer acid

<Monohydric Alcohol>

The monohydric alcohol used for the condensation of the polyester is a compound including one hydroxyl group in one molecule and is a monohydric alcohol having one oxyalkylene group. The monohydric alcohol is represented by R(OH). R represents a monovalent aliphatic, alicyclic or aromatic ring group having an oxyalkylene structure. The number of carbon atoms of R is preferably 3 or more, more preferably 6 or more, and still more preferably 8 or more. By setting the number of carbon atoms in the monohydric alcohol to be in the above range, the monohydric alcohol is prevented from vaporizing at the time of condensation reaction and the condensation reaction of the polyester can be effectively carried out.

The monohydric alcohol used in the present invention has at least one oxyalkylene group. The oxyalkylene group refers to a structure in which oxygen atoms are introduced into an alkylene chain. The alkylene chain may be a linear chain, a branched chain, or a cyclic chain. In addition, the number of carbon atoms in the alkylene chain is preferably 1 to 10, more preferably 2 to 8, and still more preferably 2 to 4. Further, the number of oxygen atoms to be introduced is preferably 1 to 10, more preferably 1 to 6, and still more preferably 1 to 4.

The monohydric alcohol used in the present invention is preferably represented by the following Formula (1).

$$R^a\text{-}(\text{-}O(CX^{a1}X^{a2})_{na1}\text{-})_{na2}OH \qquad \text{Formula (1)}$$

Here, in the Formula (1), $R^a$ represents an alkyl group which may have a substituent, a cycloalkyl group which may have a substituent, an alkenyl group which may have a substituent, an aryl group which may have a substituent, or a heteroaryl group which may have a substituent, and $X^{a1}$ and $X^{a2}$ each independently represent a hydrogen atom, a halogen atom, or an alkyl group. In addition, na1 represents an integer of 1 to 4 and na2 represents an integer of 1 to 12. In the case in which na1 is 2 or greater, na1 $X^{a1}$s may be the same or different from each other and na1 $X^{a2}$s may be the same or different from each other. In addition, in the case in which na2 is 2 or greater, na2 —$O(CX^{a1}X^{a2})_{na1}$-s may be the same or different from each other.

The number of carbon atoms in an alkyl group portion of an alkyl group which may have a substituent represented by $R^a$ is preferably 3 to 17, more preferably 4 to 13, and still more preferably 5 to 9. The alkyl group represented by $R^a$ may be a linear chain or a branched chain. In addition, $R^a$ may be a cycloalkyl group.

The number of carbon atoms in an alkenyl group portion of an alkenyl group which may have a substituent represented by $R^a$ is preferably 3 to 17, more preferably 4 to 13, and still more preferably 5 to 9. The alkenyl group represented by $R^a$ may be a linear chain, a branched chain, or a cyclic chain.

The number of carbon atoms in an aryl group portion of an aryl group or a heteroaryl group which may have a substituent represented by $R^a$ is preferably 6 to 17 and more preferably 6 to 12. Examples of the aryl group represented by $R^a$ include a phenyl group and a naphthyl group. Among these, a phenyl group is particularly preferable. In addition, examples of the heteroaryl group represented by $R^a$ include an imidazolyl group, a pyridyl group, a quinolyl group, a furyl group, a thienyl group, a benzoxazolyl group, an indolyl group, a benzimidazolyl group, a benzothiazolyl group, a carbazolyl group, and an azepinyl group. The hetero atom included in the heteroaryl group is preferably an oxygen atom, a sulfur atom, or a nitrogen tom, and among these, an oxygen atom is preferable.

Among these, in the Formula (1), $R^a$ is more preferably an alkyl group which may have a substituent. Here, the alkyl group may be an alkyl group having a branch. In addition, it is more preferable that $X^{a1}$ and $X^{a2}$ each independently represent a hydrogen atom or an alkyl group.

In the Formula (1), na1 is more preferably an integer of 1 to 3 and still more preferably an integer of 1 or 2. In addition, na2 is more preferably an integer of 1 to 8, still more preferably an integer of 1 to 6, and particularly preferably an integer of 1 to 3.

The number of carbon atoms in the monohydric alcohol represented by the Formula (1) is preferably 3 or more, more preferably 6 or more, and still more preferably 8 or more. By using such a monohydric alcohol, the monohydric alcohol can be prevented from vaporizing at the time of condensation reaction and the condensation reaction of the polyester can be effectively carried out.

Examples of a substituent that can be included in $R^a$ include a substituted or unsubstituted alkyl group having 1 to 50 carbon atoms (for example, in addition to methyl and ethyl, linear or branched propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl); an alkenyl group having 2 to 35 carbon atoms (for example, propenyl, butenyl, pentenyl, hexenyl, heptenyl, octenyl, nonenyl, decenyl, undecenyl and dodecenyl); a cycloalkyl group having 3 to 10 carbon atoms (for example, cyclopropyl, cyclobutyl, cyclopentyl, cyclohexyl and cycloheptyl); an aromatic ring group having 6 to 30 carbon atoms (for example, phenyl, naphthyl, biphenyl, phenanthryl and anthracenyl); a heterocyclic group (preferably a residue of a heterocyclic ring including at least one hetero atom selected from a nitrogen atom, an oxygen atom and a sulfur atom; for example, pyridyl, pyrimidyl, triazinyl, thienyl, furyl, pyrrolyl, pyrazolyl, imidazolyl, triazolyl, thiazolyl, oxazolyl, thiadialyl, oxadiazolyl, quinolyl and isoquinolyl); and a group consisting of a combination of these groups. If possible, these substituents may further have one or more substituents, and examples of the substituent include an alkoxy group, an alkoxycarbonyl group, a halogen atom, an ether group, an alkyl carbonyl group, a cyano group, a thioether group, a sulfoxide group, a sulfonyl group, and an amide group.

Further, the monohydric alcohol used in the present invention is more preferably represented by the following Formula (1-1).

Formula (1-1)

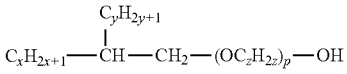

In the Formula (1-1), x represents an integer of 4 to 9, y represents an integer of 2 to 9, z represents 2 or 3, and p represents 1 or 2. In the case in which p is 2 or greater, p —$(OC_zH_{2z})$-s may be the same or different from each other.

In the present invention, by using the monohydric alcohol represented by the above Formula (1-1), the oil solubility of the complex polyester mixture can be more effectively enhanced.

Specific examples of the monohydric alcohol that can be used in the present invention will be shown below. However, the present invention is not limited thereto.

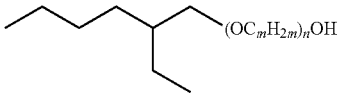

$C_{18}H_{37}(OC_mH_{2m})_nOH$ m = 2, n = 1:MA-2-2-1
m = 2, n = 4:MA-2-2-4
m = 3, n = 1:MA-2-3-1 m = 2, n = 1:MA-1-2-1
m = 2, n = 2:MA-1-2-2
m = 3, n = 1:MA-1-3-1

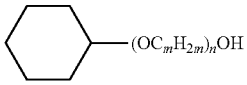

$C_2H_5(OC_mH_{2m})_nOH$ m = 2, n = 1:MA-4-2-1
m = 2, n = 3:MA-4-2-3
m = 4, n = 5:MA-4-4-5 m = 2, n = 1:MA-3-2-1

$CH_3(OC_mH_{2m})_nOH$ m = 2, n = 1:MA-5-2-1
m = 2, n = 2:MA-5-2-2
m = 2, n = 8:MA-5-2-8

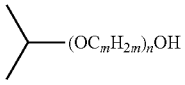

m = 2, n = 1:MA-6-2-1

$C_4H_9(OC_mH_{2m})_nOH$ m = 2, n = 1:MA-7-2-1
m = 2, n = 2:MA-7-2-2
m = 3, n = 3:MA-7-3-3

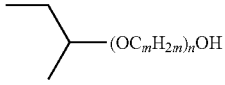

m = 2, n = 1:MA-8-2-1

$C_{10}H_{21}(OC_mH_{2m})_nOH$ m = 2, n = 1:MA-9-2-1

$C_{12}H_{25}(OC_mH_{2m})_nOH$ m = 2, n = 1:MA-10-2-1

$C_{14}H_{29}(OC_mH_{2m})_nOH$ m = 2, n = 1:MA-11-2-1

$C_{16}H_{33}(OC_mH_{2m})_nOH$ m = 2, n = 1:MA-12-2-1

$C_{18}H_{37}(OC_mH_{2m})_nOH$ m = 2, n = 1:MA-13-2-1

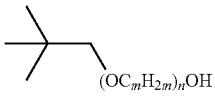

m = 2, n = 1:MA-14-2-1

$(CH_3)_3Si(OSi(CH_3)_2)_4(OC_mH_{2m})_nOH$ m = 2, n = 4:MA-16-2-4

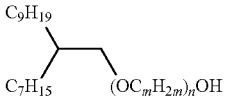

m = 2, n = 1:MA-15-2-1
m = 2, n = 4:MA-15-2-4

$C_6F_{13}C2H_4(OC_mH_{2m})_nOH$ m = 2, n = 1:MA-17-2-1

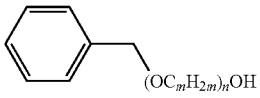

m = 2, n = 1:MA-18-2-1

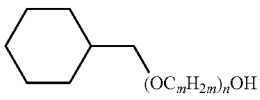

m = 2, n = 1:MA-19-2-1

-continued

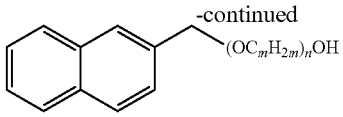

m = 2, n = 1:MA-20-2-1

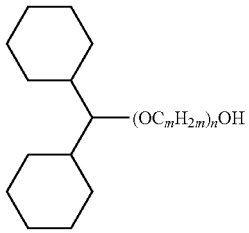

m = 2, n = 1:MA-21-2-1

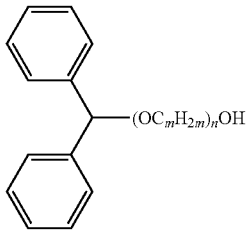

m = 2, n = 1:MA-22-2-1

$CH_2(OC_mH_{2m})_nOH$

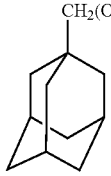

m = 2, n = 1:MA-23-2-1

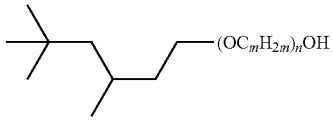

m = 2, n = 1:MA-24-2-1

(Polyester)

The complex polyester mixture in the present invention includes a polyester obtained by mixing the above-described polyhydric alcohol, polycarboxylic acid, and monohydric alcohol and condensing the mixture. At least one polyester obtained by condensing the mixture is preferably represented by the following Formula (2). The complex polyester mixture is a mixture and thus the structure thereof is not limited.

Formula (2)

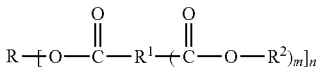

Here, in the Formula (2), R represents an n-valent atomic group, $R^1$ represents an (m+1)-valent or higher linear or cyclic aliphatic coupling group or aromatic coupling group, and $R^2$ represents a group having an oxyalkylene structure. m represents an integer of 1 to 3, and in the case in which m is 2 or greater, m $R^2$s may be the same or different from each other. In addition, n represents an integer of 3 to 6 and n —$OCOR^1$—$(COOR^2)_m$s may be the same or different from each other.

In the above Formula (2), R is more preferably a trivalent to hexavalent atom and still more preferably an integer of 3 or 4.

In the Formula (2), m represents an integer of 1 to 3 and preferably an integer of 1 or 2. That is, the polycarboxylic acid is preferably a divalent or trivalent polycarboxylic acid.

In the Formula (2), the number of carbon atoms of R is preferably 2 to 20, more preferably 2 to 15, still more preferably 2 to 10, even still more preferably 2 to 7, and particularly preferably 3 to 6.

The atoms constituting the atom group R are preferably carbon, hydrogen, and oxygen atoms. R is an aliphatic hydrocarbon atom group which may have a substituent or is preferably an aromatic hydrocarbon atom group which may have a substituent. Among these, R is particularly preferably an atom group consisting of a saturated aliphatic hydrocarbon group which may have a substituent.

$R^1$ represents a residue of the polycarboxylic acid. Here, the residue of the polycarboxylic acid refers to a group constituting a portion excluding a carboxyl group from the polycarboxylic acid. Particularly, $R^1$ is preferably a dimer acid residue or a trimer acid residue.

The number of carbon atoms of $R^1$ is preferably 5 or more, more preferably 10 or more, still more preferably 16 or more, and particularly preferably 20 or more. In addition, the number of carbon atoms of $R^1$ is preferably 64 or less, more preferably 58 or less, and still more preferably 51 or less. Among these, the number of carbon atoms of $R^1$ is preferably 20 to 51.

$R^2$ represents a group having an oxyalkylene structure. That is, $R^2$ is preferably a branched alkyl group or an alkyl group including an ether bond in the chain. In addition, the number of carbon atoms of $R^2$ is preferably 3 or more, more preferably 6 or more, and still more preferably 8 or more.

When compounds of the polyhydric alcohol, the polycarboxylic acid and the monohydric alcohol are mixed with each other, the molar ratio of the polycarboxylic acid with respect to the polyhydric alcohol is 1 to 5, and the molar ratio of the monohydric alcohol with respect to the polyhydric alcohol is preferably 0.5 to 5. That is, the mixing ratio is preferably polyhydric alcohol:polycarboxylic acid:monohydric alcohol=1:1 to 5:0.5 to 5. The mixing ratio of these components is more preferably 1:2.0 to 5:1.5 to 5 and still more preferably 1:2.2 to 5:2.5 to 5. Particularly, the side chain of the polyester is preferably end-capped. Thus, it is preferable that the total number of moles of the polyhydric alcohol and the monohydric alcohol is equal to or larger than the number of moles of the polycarboxylic acid.

The viscosity of the complex polyester mixture at 40° C. in the present invention is preferably 50 mPa·s to 2,000 mPa·s. The viscosity of the complex polyester mixture at 40° C. is preferably 50 mPa·s or more, more preferably 70 mPa·s or more, and still more preferably 100 mPa·s or more. In addition, the viscosity of the complex polyester mixture at 40° C. is preferably 2,000 mPa·s or less, more preferably 1,700 mPa·s or less, and still more preferably 1,400 mPa·s or less. By setting the viscosity of the complex polyester mixture to be in the above range, the dynamic viscosity of the lubricating oil composition for internal combustion engines can be maintained at a low level and thus the lubricating performance can be enhanced.

Since the complex polyester mixture in the present invention has the above-described structure, the mixture has an excellent property of enhancing the wear resistance of the lubricating oil composition for internal combustion engines. It is considered that such an excellent effect can be obtained because the obtained polyester has a conformation in which the side chain is arranged in a radial manner. The obtained polyester is a compound composed of a polyhydric alcohol in which the side chain can be arranged in a radial manner, a polycarboxylic acid which is connected to the polyhydric alcohol and extends in a radial manner, and a monohydric alcohol which becomes a terminal coupling group of the polycarboxylic acid. Since the side chain having the polyhydric alcohol as the center atom group is provided in the complex polyester mixture in the present invention, a larger free volume can be secured due to the conformation thereof. Thus, the wear resistance of the lubricating oil composition for internal combustion engines can be enhanced.

In the present invention, the complex polyester mixture may further include a light component in addition to a predetermined polyester. Here, the light component refers to a component having a low molecular weight and refer to an ester obtained by allowing all the carboxyl groups in the polycarboxylic acid to react with the monohydric alcohol and a component having a molecular weight smaller than that of the ester. By allowing a liquid having a lower viscosity like the light component to coexist, the viscosity of the complex polyester mixture can be further lowered. Accordingly, high lubricating performance can be exhibited.

In the complex polyester mixture in the present invention, a ratio between the predetermined polyester and the light component is not particularly limited. In the embodiment for application for lubricant, the content of the light component is preferably 50% by mass or less, more preferably 45% by mass or less, and still more preferably 40% by mass or less with respect to the predetermined polyester. The lower limit is not particularly limited and is preferably 15% by mass or more.

The ratio between the predetermined polyester and the light component can be achieved by controlling the charging ratio of three raw materials in the production method which will be described later. In addition, the ratio can be adjusted to be in a preferable range by separating the light component by distillation and the like, and mixing the light component and the remaining polyester at an arbitrary ratio.

The composition ratio between the predetermined polyester and the light component including dimer diol can be calculated by measuring each component through gel permeation chromatography (GPC). The light component gives a sharp peak in the GPC analysis and the intensity is high. Therefore, the light component is easily determined.

In the side chain of the polyester included in the complex polyester mixture, the unreacted COOH in the polycarboxylic acid may be present and the unreacted OH in the polyhydric alcohol or in the monohydric alcohol may be present. However, in the case in which OH and COOH remain, the hydroxyl value and the acid value may increase, which may be not preferable in some uses (for example, in use for lubricant). In such a case, the polyester may be separately acylated and/or esterified to remove OH and COOH in the polyester, thereby reducing the hydroxyl value and the acid value.

In order to remove OH in the polyester, the polyester having OH remaining in the side chain may be once obtained and then at least a part of OHs may be acylated. The acylation is a treatment of adding a monobasic acid ($R^1COOH$) or a monobasic acid anhydride ($(R^1CO)_2O$) to the polyester in which OH remains, followed by heating the mixture, thereby converting the remaining OH into $OCOR^1$. Reducing the hydroxyl value through the acylation is preferable from the viewpoint that the polyester can be more easily mixed with other oily medium.

In addition, a treatment of removing COOH in the polyester may be carried out. For example, the polyester may be esterified through a treatment with diazomethane or the like.

The ratio of the unreacted OH in the polyester can be determined through measurement of $^{13}C$-NMR. For use in lubricant, the OH remaining ratio in the polyester is preferably 0% to 40%, more preferably 0% to 35%, and still more preferably 0% to 30%. In addition, in the same use, the acid value of the polyester (the number of mg of KOH necessary for neutralizing one g of sample) is preferably 0 to 50, more preferably 0 to 40, and still more preferably 0 to 30. However, the invention is not limited to this range.

(Organic Metal Compound)

The lubricating oil composition for internal combustion engines of the present invention may include at least one organic metal compound of organic molybdenum compounds and organic zinc compounds in addition to the base oil and the complex polyester mixture. The content of the organic metal compound is preferably 0.001% by mass to 0.4% by mass, more preferably 0.001% by mass to 0.3% by mass, and still more preferably 0.001% by mass to 0.2% by mass with respect to the lubricating oil composition for internal combustion engines.

The content of the organic molybdenum compounds (MoDTC and the like) is preferably 2,000 ppm or less, more preferably 1,500 ppm or less, still more preferably 900 ppm or less, even still more preferably 100 ppm or less, and particularly preferably 0 ppm. In addition, the content of the organic molybdenum compounds (ZnDTP and the like) is preferably 2,000 ppm or less, more preferably 1,500 ppm or less, and still more preferably 900 ppm or less.

Examples of the organic molybdenum compound that can be used in the present invention include a complex of an organic molybdenum compound containing sulfur such as molybdenum dithiophosphate (sometimes referred to as MoDTP) and molybdenum dithiocarbamate (sometimes referred to as MoDTC); inorganic molybdenum compounds (for example, molybdenum oxides such as molybdenum dioxide and molybdenum trioxide, a molybdic acid such as an orthomolybdic acid, paramolybdic acid and molybdic acid (poly)sulfide, a molybdate such as a metal salt or ammonium salt of these molybdic acids, molybdenum sulfide such as molybdenum disulfide, molybdenum trisulfide, molybdenum pentasulfide and molybdenum polysulfide, molybdic acid sulfide, a metal salt or amine salt of molybdic acid sulfide, molybdenum halide such as molybdenum chloride, and the like); with a sulfur containing organic compound (for example, alkyl(thio)xantate, thiadiazole, mercaptothiadiazole, thiocarbonate, tetrahydrocarbyl thiuram disulfide, bis(di(thio)hydrocarbyl dithiophosphonate)disulfide, organic (poly)sulfide, sulfide ester, and the like) or other organic compounds, a complex of a sulfur containing molybdenum compound such as the above molybdenum sulfides and molybdic acid sulfides with an alkenylsuccinimide, or the like.

In addition, as the organic molybdenum compound, an organic molybdenum compound not containing sulfur as a constituent element can be used. As the organic molybdenum compound not containing sulfur, specifically, there is no limitation as long as the organic molybdenum compound is a molybdenum-amine complex represented by Formula (1) of JP2003-252887A and examples thereof include a molybdenum-succinimide complex, a molybdenum salt of an organic acid, a molybdenum salt of alcohol, and the like. Among these, a molybdenum-amine complex, a molybdenum salt of an organic acid and a molybdenum salt of alcohol are preferable.

As the production method of the above MoDTP, for example, methods disclosed in JP1986-87690A (JP-S61-87690A) and JP1986-106587A (JP-S61-106587A) can be used. That is, the MoDTP can be obtained by allowing molybdenum trioxide or molybdate to react with alkali sulfide or alkali hydrosulfide and then adding $P_2S_5$ and secondary alcohol to conduct a reaction at an appropriate temperature. As the production method of the above MoDTC, for example, a method disclosed in JP1981-12638B (JP-S56-12638B) is preferably used. That is, the MoDTC can be obtained by allowing molybdenum trioxide or molybdate to react with alkali sulfide or alkali hydrosulfide and then adding carbon disulfide and secondary amine to carry out a reaction at an appropriate temperature.

Zinc dithiophosphate (ZDTP) which is the organic zinc compound that can be used in the present invention is represented by Formula (3).

Formula (3)

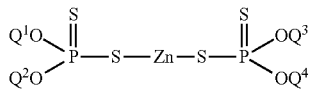

In Formula (3), $Q^1$, $Q^2$, $Q^3$, and $Q^4$ may be the same or different from one another and preferably each independently represent an alkyl group having 4 to 20 carbon atoms such as an isopropyl group, a butyl group, an isobutyl group, a pentyl group, an isopentyl group, a neopentyl group, a hexyl group, a heptyl group, an octyl group, a 2-ethylhexyl group, a nonyl group, a decyl group, an undecyl group, a dodecyl group, a tridecyl group, an isotridecyl group, a myristyl group, a palmityl group, and a stearyl group.

The organic metal compound may include metal salts or a metal-ligand complexes. Here, it is preferable that the metal is molybdenum or zinc. The ligand may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. For example, the ligand is preferably oxymolybdenum sulfide-N,N-di-octyl dithiocarbamate ($C_8$—Mo(DTC)), oxymolybdenum sulfide-N,N-di-tridecyl dithiocarbamate ($C_{16}$—Mo(DTC)), zinc n-butyl-n-pentyl dithiophosphate ($C_4/C_5$ ZnDTP), zinc di-2-ethylhexyl dithiophosphate ($C_8$ZnDTP), or zinc isopropyl-1-ethylbutyl dithiophosphate ($C_3/C_6$ ZnDTP). In addition to these compounds, Mo-containing compounds such as Mo-dithiophosphates [Mo(DTP)], Mo-amines [Mo(Am)], Mo-alcoholates, and Mo-alcohol-amides can be mentioned as examples.

In the present invention, the above-mentioned organic metal compounds may be included in the lubricating oil composition for internal combustion engines. However, the addition ratio can be suppressed to be low. Particularly, regarding the organic molybdenum compounds (MoDTC and the like), the amount ratio can be set to 100 ppm or less or set to 0 ppm. Like the organic molybdenum compounds, additives containing a metal element and a sulfur element and additives further containing phosphorus may have adverse influences on human bodies and the ecosystem through the release to the environment. In recent years, the Pollutant Release Transfer Register (PRTR) system for managing the release amount and the emission amount of chemical substances having an environmental risk has been sequentially introduced into the members of the Organization for Economic Cooperation and Development (OECD) including Japan and the use of organic molybdenum compounds (MoDTC and the like) has been reduced. In Japan, it has been required to keep the PRTR system by the Law for Promotion of Chemical Management (Kakan-Ho) since 1999 and organic molybdenum compounds (MoDTC and the like) have been designated as a target. Further, like MoDTC, additives containing a metal element and a sulfur element and additives further containing phosphorus have been known to cause clogging of a diesel particulate filter (DPF) or poisoning of an engine waste catalyst. From this circumstances, it has been desired to reduce the use of organic molybdenum compounds (MoDTC and the like) as much as possible. In the present invention, by adding the complex polyester mixture into the lubricating oil composition for internal combustion engines, the use of organic molybdenum compounds (MoDTC and the like) can be suppressed and the environmental risk can be reduced.

(Viscosity Index Improver)

A viscosity index improver may be added to the lubricating oil composition for internal combustion engines of the present invention. The number average molecular weight of a polymer used as an addable viscosity index improver is preferably about 10,000 to 1,000,000. An olefin copolymer (OCP) used as the viscosity index improver is preferably ethylene, propylene, or if necessary, a diene linear copolymer. Further, in order to improve functionality, an olefin copolymer using siloxane as a vinyl polymer is preferably used. In addition, the olefin copolymer is preferably an olefin copolymer having alkyl (meth)acrylate having a branched alkyl group as an essential constituent monomer, an olefin copolymer having acrylic ester, an olefin copolymer obtained by adding a copolymer having polystyrene as a block copolymer, or a star polymer formed by hydrogen addition of anionically polymerized isoprene.

(Other Additives)

In the condensation reaction of the complex polyester mixture in the present invention, in addition to the polyhydric alcohol, the polycarboxylic acid, and the monohydric alcohol, other components maybe used and a complex polyester mixture including a polyester to be obtained is preferably used. In addition, in addition to the above-mentioned organic metal compounds, other compounds may be incorporated.

Further, one or more additives selected from an anti-wear agent, an antioxidant, a cleaning agent, a dispersing agent, a curing agent, pour point depressant, a corrosion inhibitor, a sealability enhancer, a defoaming agent, a rust protector, a friction controlling agent, and a thickener may be added to the lubricating oil composition for internal combustion engines of the present invention.

(Production Method of Complex Polyester Mixture)

The complex polyester mixture in the present invention can be obtained by charging at least three raw materials of the above-mentioned polyhydric alcohol, polycarboxylic acid and monohydric alcohol, and subjecting these materials to dehydrating condensation. That is, the production method of the complex polyester mixture in the present invention includes a process of mixing a polyhydric alcohol having at least two hydroxyl groups, a polycarboxylic acid, and a monohydric alcohol to obtain a mixture, and a process of obtaining a polyester by subjecting the mixture to dehydrating condensation. In the production process, two raw materials (for example, polyhydric alcohol and polycarboxylic acid, or polycarboxylic acid and monohydric alcohol) may be allowed to react with each other, and then the remaining raw material may be allowed to react.

The charging ratio (mixing ratio) of the polyhydric alcohol, the polycarboxylic acid, and the monohydric alcohol is determined by the equivalent weight. The term "equivalent weight" used herein refers to the chemical equivalent of COOH or OH in reaction. When the OH number in one molecule of the polyhydric alcohol is defined as n and the molar number thereof is defined as M1, the equivalent of the polyhydric alcohol is defined as n×M1. Similarly, when the COOH number in one molecule of the polycarboxylic acid is defined as m and the molar number thereof is defined as M2, the equivalent of the polycarboxylic acid is defined as m×M2. The monohydric alcohol has one OH in one molecule, and thus when the molar number thereof is M3, then the equivalent thereof is defined as M3. The above-mentioned ratio is the ratio of these n×M1, m×M2 and M3.

The mixing ratio (molar ratio) of the respective components used for the condensation reaction of the complex polyester mixture is preferably polyhydric alcohol:polycarboxylic acid:monohydric alcohol=1:1 to 5:0.5 to 5. The mixing ratio of these components is more preferably 1:2.0 to 5:1.5 to 5 and still more preferably 1:2.2 to 5:2.5 to 5. Particularly, the side chain of the polyester is preferably end-capped, and thus it is preferable that the total number of moles of the polyhydric alcohol and the monohydric alcohol is equal to or larger than the number of moles of the polycarboxylic acid.

The mixture charged in the above manner undergoes a dehydrating condensation reaction in the presence or absence of a catalyst and thus the complex polyester mixture of the present invention is obtained.

At the time of dehydrating condensation, it is preferable that the system is heated or an appropriate amount of a solvent capable of azeotroping with water is made to exist in the system. Accordingly, the dehydration can be carried out smoothly without discoloration of the product. The solvent is preferably a hydrocarbon solvent having a boiling point of 100° C. to 200° C., more preferably a hydrocarbon solvent having a boiling point of 100° C. to 170° C., and most preferably a hydrocarbon solvent having a boiling point of 110° C. to 160° C. Examples of the solvent include toluene, xylene, and mesitylene. Regarding the amount thereof to be added, when the solvent is added too much, then the liquid temperature may be near to the temperature of the solvent and the dehydrating condensation is hardly carried out. On the other hand, when the solvent is added too small, the azeotropic reaction is not carried out smoothly. However, the amount to be added is preferably 1% by mass to 25% by mass, more preferably 2% by mass to 20% by mass, particularly preferably 3% by mass to 15% by mass, and most preferably 5% by mass to 12% by mass with respect to the total amount of the polyhydric alcohol, the polycarboxylic acid, and the monohydric alcohol.

Using a catalyst may accelerate the reaction but the post-treatment of catalyst removal is troublesome and the catalyst may cause discoloration of the product. Thus, it is preferable not to use a catalyst. However, in the case of using a catalyst, the catalyst may be an ordinary catalyst and ordinary condition and operation may be applied to the reaction. Regarding this, the references in JP2001-501989A, JP 2001-500549A, JP 2001-507334A and JP2002-509563A may be referred to here.

After the charging is completed, the materials are allowed to react at a liquid temperature of 120° C. to 250° C. preferably 130° C. to 230° C., more preferably 130° C. to 220° C., and particularly preferably 140° C. to 220° C. Accordingly, the solvent containing water can be azeotroped and cooled in a cooling zone such as a DEAN-STARK apparatus to be liquid, whereby the solvent and water are separated from each other. This water may be removed.

Regarding the reaction time, the theoretical amount of water to be generated can be calculated from the number of charging moles, and therefore it is preferable that the reaction is carried out until the water amount can be obtained. However, it is difficult to completely finish the reaction. Even when the reaction is finished at the time when the theoretical amount of water to be generated has reached from 60% to 90%, a complex polyester mixture having satisfactory lubricity can be obtained. The reaction time may be 1 hour to 24 hours, preferably from 3 hours to 18 hours, more preferably from 5 hours to 18 hours, and most preferably from 6 hours to 15 hours.

After the dehydrating condensation and the volatile component removal, further remaining OH may be acylated. In the case of the acylation, an appropriate amount of a monobasic acid ($R^1COOH$) or a monobasic acid anhydride ($(R_1CO)_2O$), preferably a monobasic acid anhydride ($(R_1CO)_2O$) is added to the system and the mixture is heated preferably at 100° C. or higher, more preferably at 120° C. or higher, and particularly preferably at 150° C. or higher, whereby at least a part, preferably almost all of the remaining OH can be converted into $OCOR^1$. The volatile component generated as a side product is preferably removed through distillation to be mentioned below. $R^1$ is an alkyl group having 1 to 10 carbon atoms or an aryl group, preferably an alkyl group having 1 to 6 carbon atoms or an aryl group, more preferably a methyl group, an ethyl group, a butyl group or a phenyl group, still more preferably a methyl group or a phenyl group, and particularly preferably a methyl group.

In addition, after the dehydrating condensation and the volatile component removal, in order to remove the remaining COOH, the product may be esterified. The esterification can be carried out by, for example, addition of diazomethane whereby at least a part, preferably almost all of the COOH can be converted into a methyl ester.

Through the reaction, the complex polyester mixture including the predetermined polyester and the light component including at least the ester formed in the above manner can be obtained. After the dehydrating condensation reaction, if desired, the acylation and/or esterification treatment is carried out and then the obtained complex polyester mixture can be used directly as it is in various applications, for example, as lubricant. In addition, depending on the use thereof, various treatments may be carried out.

After the reaction and the treatment after the reaction is completed, it is preferable that the product is filtered to remove impurities. In the case in which the complex polyester is solid, the complex polyester can be taken out after melted or can be taken out as a powder formed through reprecipitation.

EXAMPLES

The present invention will be described more concretely with reference to the following Examples and Comparative Examples. In the following Examples, the materials, the used amount, the ratio, the details of the treatment, the treatment process, and the like may be suitably modified without departing from the spirit of the invention. Accordingly, the scope of the present invention should not be interpreted in a restricted way by the specific examples shown below.

<Synthesis of Complex Polyester Mixture>

The polyhydric alcohols, the polycarboxylic acids and monohydric alcohols shown in Tables 1 and 2 were charged into a reactor equipped with a DEAN-STARK dehydration apparatus a at the molar ratios shown in Tables 1 and 2, respectively. Then, the reactor was stirred for 10 hours at a liquid temperature of 160° C. to 220° C. and a nitrogen flow rate of 0.5 L/min. Water produced during the stirring was removed. The mixture was left to cool to room temperature to obtain complex polyester mixture as a yellowish transparent liquid.

TABLE 1

| | Polyhydric alcohol | | Polycarboxylic acid | | Monohydric alcohol | |
|---|---|---|---|---|---|---|
| Complex polyester mixture | Type | Mixing amount (molar ratio) | Type | Mixing amount (molar ratio) | Type | Mixing amount (molar ratio) |
| Chem-1 | PA-2 | 1 | CA-26 | 2.2 | MA-1-2-1 | 2.5 |
| Chem-2 | PA-2 | 1 | CA-26 | 3 | MA-1-2-1 | 2.7 |
| Chem-3 | PA-2 | 1 | CA-26 | 2.4 | MA-15-2-4 | 3 |
| Chem-4 | PA-2 | 1 | CA-27 | 2.4 | MA-1-2-1 | 3.5 |
| Chem-5 | PA-2 | 1 | CA-27 | 3 | MA-6-2-1 | 4 |
| Chem-6 | PA-2 | 1 | CA-27 | 3.5 | MA-19-2-1 | 4 |
| Chem-7 | PA-13 | 1 | CA-4 | 2.2 | MA-1-2-1 | 3 |
| Chem-8 | PA-13 | 1 | CA-6 | 3.2 | MA-1-2-1 | 3 |
| Chem-9 | PA-13 | 1 | CA-7 | 4 | MA-15-2-4 | 4 |
| Chem-10 | PA-13 | 1 | CA-8 | 2.5 | MA-1-2-1 | 3 |
| Chem-11 | PA-13 | 1 | CA-10 | 2.2 | MA-6-2-1 | 3 |
| Chem-12 | PA-13 | 1 | CA-11 | 2.6 | MA-19-2-1 | 3 |
| Chem-13 | PA-13 | 1 | CA-24 | 3 | MA-15-2-4 | 4 |
| Chem-14 | PA-13 | 1 | CA-24 | 3 | MA-15-2-4 | 3 |
| Chem-15 | PA-13 | 1 | CA-26 | 3 | MA-1-2-1 | 3 |
| Chem-16 | PA-13 | 1 | CA-26 | 2.6 | MA-1-2-1 | 3 |
| Chem-17 | PA-13 | 1 | CA-26 | 3.5 | MA-1-3-1 | 4 |
| Chem-18 | PA-13 | 1 | CA-26 | 4 | MA-6-2-1 | 4 |
| Chem-19 | PA-13 | 1 | CA-26 | 3.1 | MA-19-2-1 | 3 |
| Chem-20 | PA-13 | 1 | CA-26 | 2.4 | MA-21-2-1 | 3 |
| Chem-21 | PA-13 | 1 | CA-27 | 2.4 | MA-21-2-1 | 3 |
| Chem-22 | PA-13 | 1 | CA-27 | 3 | MA-1-2-1 | 3 |
| Chem-23 | PA-13 | 1 | CA-27 | 2.6 | MA-1-2-1 | 3 |
| Chem-24 | PA-13 | 1 | CA-27 | 2.8 | MA-1-3-1 | 4 |
| Chem-25 | PA-13 | 1 | CA-27 | 2.5 | MA-6-2-1 | 3 |
| Chem-26 | PA-13 | 1 | CA-27 | 3 | MA-19-2-1 | 4 |
| Chem-27 | PA-14 | 1 | CA-4 | 2.2 | MA-1-2-1 | 3 |
| Chem-28 | PA-14 | 1 | CA-6 | 3.2 | MA-1-2-1 | 3 |
| Chem-29 | PA-14 | 1 | CA-7 | 4 | MA-15-2-4 | 4 |
| Chem-30 | PA-14 | 1 | CA-8 | 2.5 | MA-1-2-1 | 3 |
| Chem-31 | PA-14 | 1 | CA-10 | 2.2 | MA-6-2-1 | 3 |
| Chem-32 | PA-14 | 1 | CA-11 | 2.6 | MA-19-2-1 | 3 |
| Chem-33 | PA-14 | 1 | CA-24 | 3 | MA-15-2-4 | 4 |
| Chem-34 | PA-14 | 1 | CA-24 | 3 | MA-15-2-4 | 3 |
| Chem-35 | PA-14 | 1 | CA-26 | 4 | MA-1-2-1 | 4 |
| Chem-36 | PA-14 | 1 | CA-26 | 3.6 | MA-1-2-1 | 4 |
| Chem-37 | PA-14 | 1 | CA-26 | 3.5 | MA-1-3-1 | 4 |
| Chem-38 | PA-14 | 1 | CA-26 | 4 | MA-6-2-1 | 4 |
| Chem-39 | PA-14 | 1 | CA-26 | 3.1 | MA-19-2-1 | 3 |
| Chem-40 | PA-14 | 1 | CA-26 | 2.4 | MA-21-2-1 | 3 |
| Chem-41 | PA-14 | 1 | CA-27 | 2.4 | MA-21-2-1 | 3 |
| Chem-42 | PA-14 | 1 | CA-27 | 4 | MA-1-2-1 | 4 |
| Chem-43 | PA-14 | 1 | CA-27 | 3.6 | MA-1-2-1 | 4 |
| Chem-44 | PA-14 | 1 | CA-27 | 2.8 | MA-1-3-1 | 4 |
| Chem-45 | PA-14 | 1 | CA-27 | 2.5 | MA-6-2-1 | 3 |
| Chem-46 | PA-14 | 1 | CA-27 | 3 | MA-19-2-1 | 4 |

TABLE 2

| | Polyhydric alcohol | | Polycarboxylic acid | | Monohydric alcohol | |
|---|---|---|---|---|---|---|
| Complex polyester mixture | Type | Mixing amount (molar ratio) | Type | Mixing amount (molar ratio) | Type | Mixing amount (molar ratio) |
| Chem-47 | PA-15 | 1 | CA-4 | 2.2 | MA-1-2-1 | 3 |
| Chem-48 | PA-15 | 1 | CA-6 | 3.2 | MA-1-2-1 | 3 |
| Chem-49 | PA-15 | 1 | CA-7 | 4 | MA-15-2-4 | 4 |
| Chem-50 | PA-15 | 1 | CA-8 | 2.5 | MA-1-2-1 | 3 |
| Chem-51 | PA-15 | 1 | CA-10 | 2.2 | MA-6-2-1 | 3 |
| Chem-52 | PA-15 | 1 | CA-11 | 2.6 | MA-19-2-1 | 3 |
| Chem-53 | PA-15 | 1 | CA-20 | 3 | MA-21-2-1 | 4 |
| Chem-54 | PA-15 | 1 | CA-21 | 3 | MA-21-2-1 | 3 |

TABLE 2-continued

| Complex polyester mixture | Polyhydric alcohol Type | Polyhydric alcohol Mixing amount (molar ratio) | Polycarboxylic acid Type | Polycarboxylic acid Mixing amount (molar ratio) | Monohydric alcohol Type | Monohydric alcohol Mixing amount (molar ratio) |
|---|---|---|---|---|---|---|
| Chem-55 | PA-15 | 1 | CA-26 | 5 | MA-1-2-1 | 5 |
| Chem-56 | PA-15 | 1 | CA-26 | 4.6 | MA-1-2-2 | 5 |
| Chem-57 | PA-15 | 1 | CA-26 | 3.5 | MA-1-3-1 | 4 |
| Chem-58 | PA-15 | 1 | CA-26 | 4 | MA-6-2-1 | 4 |
| Chem-59 | PA-15 | 1 | CA-26 | 3.1 | MA-19-2-1 | 3 |
| Chem-60 | PA-15 | 1 | CA-26 | 2.4 | MA-21-2-1 | 3 |
| Chem-61 | PA-15 | 1 | CA-27 | 2.4 | MA-21-2-1 | 3 |
| Chem-62 | PA-15 | 1 | CA-27 | 5 | MA-1-2-1 | 5 |
| Chem-63 | PA-15 | 1 | CA-27 | 4.6 | MA-1-2-2 | 5 |
| Chem-64 | PA-15 | 1 | CA-27 | 2.8 | MA-1-3-1 | 4 |
| Chem-65 | PA-15 | 1 | CA-27 | 2.5 | MA-6-2-1 | 3 |
| Chem-66 | PA-15 | 1 | CA-27 | 3 | MA-19-2-1 | 4 |
| Chem-67 | PA-16 | 1 | CA-24 | 3 | MA-15-2-1 | 4 |
| Chem-68 | PA-16 | 1 | CA-24 | 3 | MA-15-2-4 | 3 |
| Chem-69 | PA-16 | 1 | CA-26 | 3 | MA-1-2-1 | 3 |
| Chem-70 | PA-16 | 1 | CA-26 | 2.6 | MA-1-2-2 | 3 |
| Chem-71 | PA-16 | 1 | CA-27 | 3 | MA-1-2-1 | 3 |
| Chem-72 | PA-16 | 1 | CA-27 | 2.8 | MA-1-3-1 | 4 |
| Chem-73 | PA-16 | 1 | CA-24 | 3 | MA-15-2-4 | 4 |
| Chem-74 | PA-16 | 1 | CA-26 | 2.6 | MA-1-2-1 | 3 |
| Chem-75 | PA-16 | 1 | CA-27 | 2.6 | MA-1-2-1 | 3 |
| Chem-76 | PA-16 | 1 | CA-27 | 2.8 | MA-1-3-1 | 4 |
| Chem-77 | PA-19 | 1 | CA-24 | 3 | MA-15-2-4 | 4 |
| Chem-78 | PA-19 | 1 | CA-24 | 3 | MA-15-2-4 | 3 |
| Chem-79 | PA-19 | 1 | CA-26 | 4 | MA-1-2-1 | 4 |
| Chem-80 | PA-19 | 1 | CA-26 | 3.6 | MA-1-2-2 | 4 |
| Chem-81 | PA-19 | 1 | CA-27 | 4 | MA-1-2-1 | 4 |
| Chem-82 | PA-19 | 1 | CA-27 | 3.6 | MA-1-3-1 | 4 |
| Chem-83 | PA-19 | 1 | CA-24 | 3 | MA-15-2-4 | 4 |
| Chem-84 | PA-19 | 1 | CA-26 | 2.6 | MA-1-2-1 | 3 |
| Chem-85 | PA-19 | 1 | CA-27 | 2.6 | MA-1-2-1 | 3 |
| Chem-86 | PA-19 | 1 | CA-27 | 2.8 | MA-1-3-1 | 4 |
| Chem-87 | PA-20 | 1 | CA-24 | 3 | MA-15-2-1 | 4 |
| Chem-88 | PA-20 | 1 | CA-24 | 3 | MA-15-2-4 | 3 |
| Chem-89 | PA-20 | 1 | CA-26 | 4 | MA-1-2-1 | 4 |
| Chem-90 | PA-20 | 1 | CA-26 | 3.6 | MA-1-2-2 | 4 |
| Chem-91 | PA-20 | 1 | CA-27 | 4 | MA-1-2-1 | 4 |
| Chem-92 | PA-20 | 1 | CA-27 | 3.6 | MA-1-3-1 | 4 |
| Chem-93 | PA-20 | 1 | CA-24 | 3 | MA-15-2-4 | 4 |
| Chem-94 | PA-20 | 1 | CA-26 | 2.6 | MA-1-2-1 | 3 |
| Chem-95 | PA-20 | 1 | CA-27 | 2.6 | MA-1-2-1 | 3 |
| Chem-96 | PA-20 | 1 | CA-27 | 2.8 | MA-1-3-1 | 4 |

<Preparation of Base Oil>

The base oils used in Examples and Comparative Examples are as follows.

Base oil A (HTHS viscosity: 1.9 mPa·s, NOACK evaporation amount: 15%)

Base oil B (HTHS viscosity: 1.7 mPa·s, NOACK evaporation amount: 28%)

Base oil C (HTHS viscosity: 1.5 mPa·s, NOACK evaporation amount: 40%)

Base oil D (HTHS viscosity: 1.9 mPa·s, NOACK evaporation amount: 10%)

Base oil E (HTHS viscosity: 1.7 mPa·s, NOACK evaporation amount: 12%)

Base oil F (HTHS viscosity: 1.5 mPa·s, NOACK evaporation amount: 15%)

Base oil G (HTHS viscosity: 2.6 mPa·s, NOACK evaporation amount: 12%)

Base oil H (HTHS viscosity: 2.3 mPa·s, NOACK evaporation amount: 15%)

GF-5 5W-30 (HTHS viscosity: 3.1 mPa·s, NOACK evaporation amount: 13%)

GF-5 0W-20 (HTHS viscosity: 2.7 mPa·s, NOACK evaporation amount: 14%)

Here, the HTHS viscosity refers to a shear viscosity at 150° C.

Representative examples are shown in the following description. However, since oils can be prepared at various levels by mixing according to the preparation method, only basic oils may be determined in the specification.

As the base oil to be mixed, a lubricating oil component obtained by subjecting crude oil to atmospheric distillation and/or vacuum distillation was refined through one refining treatment or in combination of two or more refining treatments of (1) solvent deasphalting, (2) solvent extraction, (3) hydrocracking, (4) a dewaxing treatment such as solvent dewaxing or catalyst dewaxing, (5) hydrorefining, and (6) a refining treatment such as sulfuric acid pickling or clay treatment to obtain a paraffin-based base oil. This paraffin-based base oil was used for the test.

In the case in which the NOACK evaporation amount was high, the NOACK evaporation amount was adjusted by mixing the base oil with a poly-α-olefin (hereinafter, abbreviated as PAO) oil and a mixture was prepared by mixing so as to satisfy a predetermined NOACK evaporation amount. As the poly-α-olefin oil, "SYNFLUIDs 201, 401, 601, 801, 2 cst, 2.5 cst, 4 cst, 5 cst, 6 cst, 7 cst, and 8 cst", produced by NIPPON STEEL & SUMIKIN CHEMICAL CO., LTD. (trademark: CHEVRON PHILLIPS) were used.

Regarding the method of mixing the poly-α-olefin oil and the paraffin-based base oil, a method of mixing a paraffin-based base oil having a HTHS viscosity of 1.2 to 2.7 and SYNFLUIDs 201, 401, 601, 2 cst, 2.5 cst, 4 cst, 5 cst, 6 cst, 7 cst, and 8 cst was used and in the case in which the HTHS viscosity was high, the viscosity was adjusted by lowering the viscosity using SYNFLUIDs 201, 401, 2 cst, 2.5 cst, 4 cst and 5 cst, or a paraffin-based base oil having a low viscosity corresponding to a HTHS viscosity of 1.2 to 1.9. In the case in which the NOACK evaporation amount was high, the NOACK evaporation amount was adjusted by reducing the NOACK evaporation amount using SYNFLUIDs 5 cst (NOACK evaporation amount: 5.6) and 6 cst (NOACK evaporation amount: 6.6).

Specifically, as Base oils A, B, and C, paraffin-based base oils (produced by Exxon Mobil Corporation, HTHS viscosity: 1.9 mPa·s, 1.7 mPa·s, 1.5 mPa·s) which were included in one of partially hydrogenated mineral oils were used.

Base oil D was prepared by mixing poly-α-olefin oil-based base oils SYNFLUIDs 4 cst, 5 cst, and 401 in a range of 20% to 80% with respect to a paraffin-based base oil (produced by Exxon Mobil Corporation, HTHS viscosity: 3.6 mPa·s to 1.7 mPa·s) such that the HTHS viscosity was 1.9 mPa·s and the NOACK evaporation amount was 10%.

Base oil E was prepared by mixing poly-α-olefin oil-based base oils SYNFLUIDs 4 cst, 5 cst, and 401 in a range of 20% to 80% with respect to a paraffin-based base oil (produced by Exxon Mobil Corporation, HTHS viscosity: 2.6 mPa·s to 1.5 mPa·s) such that the HTHS viscosity was 1.7 mPa·s and the NOACK evaporation amount was 12%.

Base oil F was prepared by mixing poly-α-olefin oil-based base oils SYNFLUIDs 4 cst, 5 cst, and 401 in a range of 20% to 80% with respect to a paraffin-based base oil (produced by Exxon Mobil Corporation, HTHS viscosity: 2.6 mPa·s to 1.5 mPa·s) such that the HTHS viscosity was 1.5 mPa·s and the NOACK evaporation amount was 15%.

Base oil G was prepared by mixing poly-α-olefin oil-based base oils SYNFLUIDs 4 cst, 5 cst, and 401 in a range of 0% to 80% with respect to a paraffin-based base oil (produced by Exxon Mobil Corporation, HTHS viscosity: 2.6 mPa·s to 1.5 mPa·s) such that the HTHS viscosity was 2.6 mPa·s and the NOACK evaporation amount was 12%.

Base oil H was prepared by mixing poly-α-olefin oil-based base oils SYNFLUIDs 4 cst, 5 cst, and 401 in a range of 0% to 80% with respect to a paraffin-based base oil (produced by Exxon Mobil Corporation, HTHS viscosity: 2.6 mPa·s to 1.5 mPa·s) such that the HTHS viscosity was 2.3 mPa·s and the NOACK evaporation amount was 15%.

Base oils A to F can be prepared by methods other than the above-mentioned preparation method. For example, in the case of preparing Base oil D, the composition of the base oil can be prepared by mixing SYNFLUIDs 6 cst, 7 cst, 8 cst or 601, and 801, as poly-α-olefin oil-based base oils, in a range of 20% to 100% with respect to a paraffin-based base oil (HTHS viscosity: 1.1 to 1.7) so as to have a predetermined viscosity and a predetermined NOACK evaporation amount. Further, the base oil also can be prepared by mixing SYNFLUIDs 2 cst, 2.5 cst, 4 cst, 5 cst, 6 cst, 601, 7 cst, 8 cst or 601, and 801, as poly-α-olefin oil-based base oils, without using the paraffin-based base oil so as to have a predetermined viscosity and a predetermined NOACK evaporation amount.

In addition, in a case of Base oil E, as another preparation method, the base oil can be prepared by mixing SYNFLUIDs 5 cst, 6 cst, 601, 7 cst, 8 cst or 601, and 801, as poly-α-olefin oil-based base oils, in a range of 30% to 80% with respect to a paraffin-based base oil (HTHS viscosity: 1.1 to 1.5) so as to have a predetermined viscosity and a predetermined NOACK evaporation amount. Further, the base oil also can be prepared by mixing SYNFLUIDs 2 cst, 2.5 cst, 4 cst, 5 cst, 6 cst, 601, 7 cst, 8 cst or 601, and 801, as poly-α-olefin oil-based base oils, without using the paraffin-based base oil so as to have a predetermined viscosity and a predetermined NOACK evaporation amount.

Further, in a case of Base oil F, as another preparation method, the base oil can be prepared by mixing SYNFLUIDs 4 cst, 5 cst, 6 cst, 601, 7 cst, 8 cst or 601, and 801, as poly-α-olefin oil-based base oils, in a range of 30% to 80% with respect to a paraffin-based base oil (HTHS viscosity: 1.1 to 1.3) so as to have a predetermined viscosity and a predetermined NOACK evaporation amount. Further, depending on the circumstances, the base oil is adjusted to a predetermined lubricant oil composition by mixing SYNFLUIDs 2 cst, and 2.5 cst or 201, as poly-α-olefin oil-based base oils, in a range of 1% to 20%. Further, the base oil also can be prepared by mixing SYNFLUIDs 2 cst, 2.5 cst, 4 cst, 5 cst, 6 cst, 601, 7 cst, 8 cst or 601, and 801 as poly-α-olefin oil-based base oils without using a paraffin-based base oil so as to have a predetermined viscosity and a predetermined NOACK evaporation amount.

Regarding the standard oils GF-5 5W-30 and GF-5 0W-20 used in Comparative Examples, TOYOTA CASTELO SN 5W-30 and SN 0W-20 produced by Exxon Mobil Corporation were used.

Example 1

<Preparation of Lubricating Oil Composition for Internal Combustion Engines>

The complex polyester mixture (Chem-15) was added to Base oil A at a ratio shown in Table 3 and the materials were mixed for one minute or longer by stirring. Thus, a lubricating oil composition for internal combustion engines was prepared.

Examples 2 to 25

Lubricating oil compositions for internal combustion engines were prepared in the same manner as in Example 1 except that the base oil and the complex polyester mixture were changed as shown in Tables 3 and 4 and the ratio thereof was changed as shown in Tables 3 and 4. For the type of the complex polyester mixture, Chem-15, Chem-16, and Chem-33 were used.

Comparative Examples 1 to 14

Lubricating oil compositions for internal combustion engines were prepared in the same manner as in Example 1 except that except that the base oil and the complex polyester mixture were changed as shown in Table 5 and the ratio thereof was changed as shown in Table 5. In Comparative Examples 1 to 12, the complex polyester mixture was not used. In addition, in Comparative Examples 7 to 12, an anti-wear additive was used as shown in Table 5.

Regarding IRGALUBE used as the anti-wear additive, the following products produced by BASF were used.

- IRGALUBE 63 (ethyl-3-[[bis(1-methylethoxy)phosphinothioyl]thio]propionate)
- IRGALUBE 211 (O,O,O-tris[(2 or 4)-C9 to C10 isoalkylphenol]thiophosphate)
- IRGALUBE 232 (mixture of triphenyl thiophosphate ester and tert-butylphenyl derivative)
- IRGALUBE 349 (amine, C11-14 side chain alkyl, monohexyl, and dihexyl phosphate)
- IRGALUBE 353 (3-(di-isobutoxy-thiophosphorylsulfanyl)-2-methyl-propyonate)
- IRGALUBE TPPT (0,0,0-triphenyl phosphorothioate)

Regarding the solubility of the anti-wear additive, the lubricating oil composition obtained by mixing of the anti-wear additive after stirring for one minute was left to stand for 30 minutes and whether precipitate is present or not was confirmed. IRGALUBE TPPT is solid at normal temperature and the concentration could be increased to 1% concentration which was suitable for the test. Thus, precipitation was formed as a solid. Since the others maintain a liquid state at normal temperature, others could be used in the predetermined wear test.

For the comparison of the performance of the anti-wear additives with the performance of well-known anti-wear additives in the oil, the amounts of the anti-wear additives to be added were compared in additive concentration range which could not meet ILSAC GF-5 oil standards (the addition amount was more than the total amount of P of 0.08% and the total amount of S of 0.5%). In the ILSAC GF-5 standards, the addition amount is defined to the total amount of P of 0.08% or less and the total amount of S of 0.5% or less by consultation between Society of Automotive Engineers of Japan, Inc. and Society of Automotive Engineers (API technical bulletin JAPI J 1509 EOLCS 16th EDITION, Jun. 17, 2010, MONTHLY TRIBOLOGY 2011-12, p26-27, ENEOS technical review 52(2), 2012-05).

<Evaluation>

(Fuel Efficiency (Friction Reduction Effect))

The mechanical friction was in the case in which the engine oil was changed in a state in which a vehicle was equipped with the entire engine was measured. For the engine for internal combustion supplied in this test, a 4 cylinder engine with name "3ZR-FE", manufactured by Toyota Motor Corporation, corresponding to a standard displacement of 2,000 cc was used. For the measurement method, a friction measurement method was employed. The friction measurement method is a method for measuring driving torque using a direct current dynamometer by driving an engine in a state in which the combustion of the engine is stopped. The method is used because the reproducibility can be relatively easily enhanced and the frication loss can be relatively easily measured. The amount of reduction in the friction is directly connected to reduced torque. In general, the reduced torque is converted into a special friction average effective pressure (abbreviation: FMEP) and the converted value is used for calculation. The fuel efficiency effect is calculated by vehicle manufacturers based on the index. The equation for calculation is represented by Equation (1).

Friction average effective pressure=friction loss event/piston displacement=4π×torque (N·m)/displacement amount Equation (1)

Regarding mode fuel efficiency, the amount of reduction in FMEP at 2,000 rpm is generally directly connected fuel efficiency and the fuel efficiency sensitivity of mechanical loss of each engine to FMEP is generally proportional to FMEP. The estimated fuel efficiency was obtained by multiplying FMEP by an independent fuel efficiency sensitivity coefficient of each engine. In Examples and Comparative Examples, the estimated fuel efficiency thereof was evaluated based on the following criteria. When the evaluation result was C rank or higher, the oil was acceptable.

A: The rate of reduction in friction average effective pressure was 3% or more.

(The fuel consumption reduction rate (%) was −3% or less)

B: The rate of reduction in friction average effective pressure was 1.5% or more and less than 3%.

(The fuel consumption reduction rate (%) was more than −3% and −1.5% or less)

C: The rate of reduction in friction average effective pressure was more than 0% and less than 1.5%.

(The fuel consumption reduction rate (%) was more than −1.5% and less than 0%)

D: The rate of reduction in friction average effective pressure was 0% or less.

(The fuel consumption reduction rate (%) was 0% or more)

(Amount of Wear)

The amount of wear was measured by a pin-off block system based on ASTM D 2670. As the measurement apparatus, a high speed Falex type friction tester (manufactured by Shinko Engineering Co. Ltd.) was used. The shape of a pin used for the measurement was set to 6.35ϕ×25.4 mm and the material used was SAE 3135 (Ni—Cr steel). In addition, the hardness of the pin was $H_{RB}$ 87 to 91 and the 10-point average roughness was 10 RMS MAX. The shape of a V type block used for the measurement was set to 12.7ϕ×12.7 mm and the angle was set to 96°. The material used was AISI 1137 (free-cutting steel). In addition, the hardness of the pin was $H_{RC}$ 20 to 24 and the 10-point average roughness was 10 RMX MAX. For the supply portion of the lubricating oil, the lubricating oil compositions of Examples and Comparative Examples used in this wear test was supplied to the pin from the upper side of the pin to the lower side so as to flow between the pin and the block.

In the Falex (amount of wear) test, a load of 135 kg was applied to a load portion shown in FIG. 1 for 5 minutes for a running-in operation. Then, the load was changed to 315 kg and the operation was carried out for 15 minutes. After the completion of the test, the amount of reduction in wear between the pin and the V block was measured and the total amount of wear was obtained. FIG. 1 shows a view schematically showing the configuration of an apparatus used in the Falex test.

Regarding wear resistance, the amount of wear was evaluated in 5 stages. When the evaluation result was B rank or higher, the oil was acceptable.

A: The amount of wear was less than 8 mg.

B: The amount of wear was 8 mg or more and less than 10 mg.

C: The amount of wear was 10 mg or more and less than 12.5 mg.

D: The amount of wear was 12.5 mg or more and less than 15 mg.

E: The amount of wear was 15 mg or more.

(Evaporation)

The evaporation of the lubricating oil compositions for internal combustion engines obtained in Examples and Comparative Examples was evaluated in a NOACK test (250° C. for 1 hour) by measuring the evaporation reduction amount. The percentage of mass after the test/mass before the test is called a NOACK evaporation amount. At this time, a test for satisfying the requirement that the evaporation amount in the current GF-5 soil standards is preferably 30% by mass or less and/or the flash point is 200° C. or higher that is equal to the flash points of Class IV petroleums was conducted.

Regarding the NOACK evaporation amount, the NOACK evaporation amount was evaluated in 3 stages. Even when the evaluation result of the evaporation reduction amount is C rank, the oil is at a practically usable level.

A: The evaporation reduction amount was 15% or less.

B: The evaporation reduction amount was more than 15% and less than 30%.

C: The evaporation reduction amount was 30% or more.

(Solubility of Anti-Wear Additive)

Regarding the determination level of saturation solubility, 5 g of an anti-wear additive was added to 100 g of an engine oil suitable for ILSAC GF-5 0W-20 as the current oil standards and the mixture was dispersed. Then, the resultant was filtered an oil filter defined by JIS standards and whether insoluble components were present or not was confirmed. Then, in the case in which emulation was formed, the filtered resultant was left to stand still for 24 hr and whether precipitate was formed or not was visually confirmed.

Thereafter, the mass of the precipitate and solid products (hereinafter, also referred to as insoluble components) captured by the filter was measured and the solubility was calculated from (initial additive mass (5 g)−insoluble component mass)/(initial oil mass (100 g)).

A: The solubility was 2.5% or higher.

B: The solubility was 1.0% or higher and lower than 2.5%.

C: The solubility was 0.25% or higher and lower than 1.0%.

D: The solubility was lower than 0.25%.

TABLE 3

| | | Example 1 | Example 2 | Example 3 | Example 4 | Example 5 | Example 6 | Example 7 | Example 8 |
|---|---|---|---|---|---|---|---|---|---|
| Polyester mixture | Type | Chem-15 | Chem-15 | Chem-15 | Chem-15 | Chem-16 | Chem-16 | Chem-16 | Chem-16 |
| | Addition ratio (% by mass) | 1 | 1 | 1 | 1 | 2.5 | 0.5 | 2.5 | 0.5 |

TABLE 3-continued

| | | | | | | | | | |
|---|---|---|---|---|---|---|---|---|---|
| Anti-wear additive | Type | — | — | — | — | — | — | — | — |
| | Solubility | | | | | | | | |
| Base oil | Name of base oil type | Base oil A | Base oil B | Base oil C | Base oil G | Base oil B | Base oil B | Base oil C | Base oil C |
| | Type of base oil material | Paraffin-based | Paraffin-based | Paraffin-based | PAO + Paraffin | Paraffin-based | Paraffin-based | Paraffin-based | Paraffin-based |
| Lubricating oil composition | High temperature shear viscosity (HTHS viscosity) (mPa · s) | 1.9 | 1.7 | 1.5 | 2.6 | 1.7 | 1.7 | 1.5 | 1.5 |
| | NOACK evaporation amount (%) | 15 | 28 | 40 | 12 | 28 | 28 | 40 | 40 |
| Organic metal compound 1 | Type | MoDTC | MoDTC | MoDTC | MoDTC | MoDTC | MoDTC | MoDTC | MoDTC |
| | Addition ratio (ppm) | 900 | 900 | 900 | 900 | 900 | 900 | 900 | 900 |
| Organic metal compound 2 | Type | ZnDTP | ZnDTP | ZnDTP | ZnDTP | ZnDTP | ZnDTP | ZnDTP | ZnDTP |
| | Addition ratio (ppm) | 900 | 900 | 900 | 900 | 900 | 900 | 900 | 900 |
| Evaluation | Fuel consumption reduction rate (%) | −1.21 | −2.36 | −4.01 | −0.21 | −2.74 | −2.38 | −3.65 | −3.93 |
| | Amount of wear (mg) | 4.8 | 4.7 | 7.7 | 4.4 | 4.2 | 6.3 | 4.7 | 7.8 |
| Determination | Fuel efficiency | C | B | A | C | B | B | A | A |
| | Amount of wear | A | A | A | A | A | A | A | A |
| | Evaporation amount | A | B | C | A | B | B | C | C |

| | | Example 9 | Example 10 | Example 11 | Example 12 | Example 13 | Example 14 |
|---|---|---|---|---|---|---|---|
| Polyester mixture | Type | Chem-16 | Chem-15 | Chem-15 | Chem-15 | Chem-15 | Chem-33 |
| | Addition ratio (% by mass) | 1 | 1 | 1 | 1 | 1 | 1 |
| Anti-wear additive | Type | — | — | — | — | — | — |
| | Solubility | | | | | | |
| Base oil | Name of base oil type | Base oil B | Base oil D | Base oil E | Base oil F | Base oil F | Base oil B |
| | Type of base oil material | Paraffin-based | PAO + Paraffin | PAO + Paraffin | PAO + Paraffin | PAO + Paraffin | Paraffin-based |
| Lubricating oil composition | High temperature shear viscosity (HTHS viscosity) (mPa · s) | 1.7 | 1.9 | 1.7 | 1.5 | 1.5 | 1.7 |
| | NOACK evaporation amount (%) | 28 | 10 | 12 | 15 | 15 | 28 |
| Organic metal compound 1 | Type | MoDTC | MoDTC | MoDTC | MoDTC | MoDTC | MoDTC |
| | Addition ratio (ppm) | 100 | 900 | 900 | 900 | 100 | 900 |
| Organic metal compound 2 | Type | ZnDTP | ZnDTP | ZnDTP | ZnDTP | ZnDTP | ZnDTP |
| | Addition ratio (ppm) | 900 | 900 | 900 | 900 | 900 | 900 |
| Evaluation | Fuel consumption reduction rate (%) | −2.36 | −1.21 | −2.36 | −4.01 | −4.01 | −2.12 |
| | Amount of wear (mg) | 4.8 | 4.4 | 4.6 | 4.8 | 5.4 | 8.9 |

TABLE 3-continued

| | | | | | | | |
|---|---|---|---|---|---|---|---|
| Determination | Fuel efficiency | B | C | B | A | A | B |
| | Amount of wear | A | A | A | A | A | B |
| | Evaporation amount | B | A | A | A | A | B |

TABLE 4

| | | Example 15 | Example 16 | Example 17 | Example 18 | Example 19 | Example 20 | Example 21 | Example 22 | Example 23 | Example 24 | Example 25 |
|---|---|---|---|---|---|---|---|---|---|---|---|---|
| Polyester mixture | Type | Chem-15 | Chem-15 | Chem-15 | Chem-15 | Chem-15 | Chem-15 | Chem-15 | Chem-15 | Chem-15 | Chem-15 | Chem-15 |
| | Addition ratio (% by mass) | 1 | 1 | 1 | 1 | 1 | 1 | 1 | 1 | 1 | 1 | 1 |
| Anti-wear additive | Type | — | — | — | — | — | — | — | — | — | — | — |
| | Solubility | | | | | | | | | | | |
| Base oil | Name of base oil type | Base oil G | Base oil H | Base oil A | Base oil B | Base oil C | Base oil A | Base oil B | Base oil C | Base oil D | Base oil E | Base oil F |
| | Type of base oil material | PAO + Paraffin | PAO + Paraffin | Paraffin-based | Paraffin-based | Paraffin-based | Paraffin-based | Paraffin-based | Paraffin-based | PAO + Paraffin | PAO + Paraffin | PAO + Paraffin |
| Lubricating oil composition | High temperature shear viscosity (HTHS viscosity) (mPa · s) | 2.6 | 2.3 | 1.9 | 1.7 | 1.5 | 1.9 | 1.7 | 1.5 | 1.9 | 1.7 | 1.5 |
| | NOACK evaporation amount (%) | 12 | 15 | 15 | 28 | 40 | 15 | 28 | 40 | 10 | 12 | 15 |
| Organic metal compound 1 | Type | MoDTC | MoDTC | MoDTC | MoDTC | MoDTC | MoDTC | MoDTC | MoDTC | MoDTC | MoDTC | MoDTC |
| | Addition ratio (ppm) | 0 | 0 | 0 | 0 | 0 | 100 | 100 | 100 | 0 | 0 | 0 |
| Organic metal compound 2 | Type | ZnDTP | ZnDTP | ZnDTP | ZnDTP | ZnDTP | ZnDTP | ZnDTP | ZnDTP | ZnDTP | ZnDTP | ZnDTP |
| | Addition ratio (ppm) | 900 | 900 | 900 | 900 | 900 | 900 | 900 | 900 | 900 | 900 | 900 |
| Evaluation | Fuel consumption reduction rate (%) | −1.21 | −0.48 | −1.21 | −2.36 | −4.01 | −1.21 | −2.36 | −4.01 | −1.21 | −2.36 | −4.01 |
| | Amount of wear (mg) | 4.2 | 4.3 | 4.8 | 5.1 | 8.1 | 4.5 | 4.7 | 6.3 | 5.6 | 5.9 | 8 |
| Determination | Fuel efficiency | C | C | C | B | A | C | B | A | C | B | A |
| | Amount of wear | A | A | A | A | B | A | A | A | A | A | B |
| | Evaporation amount | A | A | A | B | C | A | B | C | A | A | A |

TABLE 5

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Polyester mixture | Type | — | — | — | — | — | — | — | — |
| | Addition ratio (% by mass) | 0 | 0 | 0 | 0 | 0 | 0 | 0 | 0 |
| Anti-wear additive | Type | — | — | — | — | — | — | Triphenyl phosphate-based | |
| | | | | | | | | IRGALUBE 211 | IRGALUBE 232 |
| | Solubility | | | | | | | A | A |
| Base oil | Name of base oil type | GF-5 5W-30 | GF-5 0W-20 | Base oil A | Base oil B | Base oil C | Base oil C | Base oil C | Base oil C |
| | Type of base oil | Paraffin-based | Paraffin-based | Paraffin-based | Paraffin-based | Paraffin-based | Paraffin-based | Paraffin-based | Paraffin-based |

TABLE 5-continued

| | | | | | | | | | |
|---|---|---|---|---|---|---|---|---|---|
| Lubricating oil composition | High temperature shear viscosity (HTHS viscosity) (mPa · s) | 3.1 | 2.7 | 1.9 | 1.7 | 1.5 | 1.5 | 1.5 | 1.5 |
| | NOACK evaporation amount (%) | 13 | 14 | 15 | 28 | 40 | 40 | 40 | 40 |
| Organic metal compound 1 | Type | MoDTC | MoDTC | MoDTC | MoDTC | MoDTC | MoDTC | MoDTC | MoDTC |
| | Addition ratio (ppm) | 900 | 900 | 900 | 900 | 900 | 100 | 100 | 100 |
| Organic metal compound 2 | Type | ZnDTP | ZnDTP | ZnDTP | ZnDTP | ZnDTP | ZnDTP | ZnDTP | ZnDTP |
| | Addition ratio (ppm) | 900 | 900 | 900 | 900 | 900 | 900 | 900 | 900 |
| Evaluation | Fuel consumption reduction rate (%) | +1.2 | 0 | −1.21 | −2.36 | −4.01 | −2.33 | −2.33 | −2.33 |
| | Amount of wear (mg) | 5.3 | 6.7 | 10.5 | 12.8 | 15.6 | >15.6 | >15.6 | >15.6 |
| Determination | Fuel efficiency | D | D | C | B | A | B | B | B |
| | Amount of wear | A | A | C | D | E | E | E | E |
| | Evaporation amount | A | A | A | B | C | C | C | C |

| | | | Comparative Example 9 | Comparative Example 10 | Comparative Example 11 | Comparative Example 12 | Comparative Example 13 | Comparative Example 14 |
|---|---|---|---|---|---|---|---|---|
| | Polyester mixture | Type | — | — | — | — | Chem-15 | Chem-15 |
| | | Addition ratio (% by mass) | 0 | 0 | 0 | 0 | 1 | 1 |
| | Anti-wear additive | Type | Triphenyl phosphate-based | Dithiophosphate-based | | Amine phosphate-based | — | — |
| | | | IRGALUBE TPPT | IRGALUBE 63 | IRGALUBE 353 | IRGALUBE 349 | | |
| | | Solubility | D | A | A | A | | |
| | Base oil | Name of base oil type | Base oil C | Base oil C | Base oil C | Base oil C | GF-5 5W-30 | GF-5 0W-20 |
| | | Type of base oil | Paraffin-based | Paraffin-based | Paraffin-based | Paraffin-based | Paraffin-based | Paraffin-based |
| | Lubricating oil composition | High temperature shear viscosity (HTHS viscosity) (mPa · s) | 1.5 | 1.5 | 1.5 | 1.5 | 3.1 | 2.7 |
| | | NOACK evaporation amount (%) | 40 | 40 | 40 | 40 | 13 | 14 |
| | Organic metal compound 1 | Type | MoDTC | MoDTC | MoDTC | MoDTC | MoDTC | MoDTC |
| | | Addition ratio (ppm) | 100 | 100 | 100 | 100 | 100 | 100 |
| | Organic metal compound 2 | Type | ZnDTP | ZnDTP | ZnDTP | ZnDTP | ZnDTP | ZnDTP |
| | | Addition ratio (ppm) | 900 | 900 | 900 | 900 | 900 | 900 |
| | Evaluation | Fuel consumption reduction rate (%) | −2.33 | −2.33 | −2.33 | −2.33 | +1.2 | 0 |
| | | Amount of wear (mg) | >15.6 | >15.6 | >15.6 | >15.6 | 4.1 | 4.2 |
| | Determination | Fuel efficiency | B | B | B | B | D | D |
| | | Amount of wear | E | E | E | E | A | A |
| | | Evaporation amount | C | C | C | C | A | A |

As seen from Tables 3 to 5, it is found that the lubricating oil compositions for internal combustion engines of Examples 1 to 25 exhibit satisfactory fuel efficiency and the amount of wear is reduced. In addition, the evaporation amount of the lubricating oil compositions for internal combustion engines is suppressed.

On the other hand, it is found that the lubricating oil compositions for internal combustion engines of Comparative Examples 1 to 14 exhibit poor fuel efficiency or insufficient wear reliability and improved fuel efficiency and wear resistance performance are not achieved.

From Comparative Examples 1 and 2 in Table 5, it is found that in the oils having a high HTHS viscosity of 2.7 to 3.2, the amount of wear can be sufficiently reduced and thus can be made less than an amount of wear of 10 mg or more, which is a reference. However, in oils having a HTHS viscosity of 2.6 or less like Comparative Examples 3 to 12, the amount of wear is more than 10 mg or more and the value of reduction in wear corresponding to future oil consumption and component durability cannot be provided.

On the other hand, from Tables 3 and 4, in the case of adding the complex polyester mixture, it is fund that the amount of wear can be significantly reduced. It is found that as in Examples 1 to 25 in Tables 3 and 4, by adding the complex polyester mixture to the lubricating oil, the wear resistance amount of a low viscosity oil having a low HTHS viscosity can be improved to a level higher than the level of the wear resistance of the oil having a HTHS viscosity of 3.2 (5W-30 of GF-5 standards) with high reliability. Further, when the performance of the complex polyester mixtures (Chem-15) and (Chem-16) was compared and investigated, it could be confirmed that the performance in the requirement range met the standards and thus there was no problem in the difference in performance in the both mixtures. In addition, it could be easily imagined that it was also effect on a PAO base oil having a HTHS viscosity of 1.0 from the prediction line. It could be confirmed that the anti-wear effect was imparted to a future ultra low viscosity oil including a large amount of low boiling point components having 18 or more carbon atoms. Further, as seen from Table 4, in the present invention, even in the case in which no MoDTC was added, a lubricating oil composition in which the fuel efficiency was satisfactory and the amount of wear was reduced could be obtained.

In addition, regarding an anti-wear additive, additives which has been conventionally used exhibit wear resistance performance by a mechanism in which the surface is modified using adsorption of a phosphate group, a sulfate group, a sulfide group, or the like to a metal interface. At this time, the conventional additives were excluded since there was a problem that depending on the type of the modification group of these anti-wear additives, in comparison of a sulfate-based anti-wear additive with a phosphate-based anti-wear additive, the amount to be used could not be increased from the viewpoint of wear resistance performance for a long period of time and S concentration reduction requirement in the oil standards and the amount to be used in this evaluation was 1%, which was not suitable for a large amount addition test. Three representative types of phosphate-based materials of triphenyl phosphate-based, dithiophosphate-based, and amine phosphate-based additives were used for this evaluation as targets for comparison. As seen from Comparative Examples 7 to 12 in Table 4, it could be confirmed that even in the case of using the anti-wear additives, there was no material exhibiting wear resistance performance which was higher than the wear resistance performance of Examples of the present invention and the lubricating oil composition which satisfied required wear resistance performance could be obtained by using only the material of the complex polyester mixture used in the present invention.

In addition, the complex polyester mixture used in the present invention can sufficiently exhibit the effect only with a small addition concentration. The complex polyester mixture used in the present invention has an advantage in that even in the case in which the complex polyester mixture used in the present invention is incorporated at a low concentration of 1% by mass or less, the effect can be exhibited with addition of a low viscosity base oil having a viscosity of 17.4 $mm^2/s$ to 66.0 $mm^2/s$.

The NOACK evaporation amount is preferably 30% or less of the amount of the oil standards and the NOACK evaporation amount, which is less than 15%, in these Examples 12 to 15 can be easily increased to 30% by increasing the amount of the mineral oil. As the base oil, a mixed oil of a total synthesis oil such as PAO and a mineral oil can be used. The mixing ratio thereof is set by mixing an expensive PAO base oil and a cheap mineral oil and thus a price trade-off relationship in which in the case in which the NOACK evaporation amount increases, the price can be reduced and when the NOACK evaporation amount is reduced, the price increases is established. At this time, it could be confirmed that the NOACK evaporation amount could be reduced by incorporating a total synthesis base oil such as PAO and the effectiveness could be confirmed. Since a total synthesis base oil such as PAO can be incorporated, it can be confirmed that an ester-based or isoparaffin-based total synthesis oil also can be used as a substitute base oil and a naphthene-based base oil also can be used as a substitute base oil for a mineral oil.

In Comparative Example 13 and 14 in Table 5, even in the case of adding the complex polyester mixture, at a HTHS viscosity of 3.2 (5W-30 of GF-5 standards) to HTHS viscosity of 2.7 (0W-20 of GF-5 standards), the current fuel efficiency effect cannot be increased. Thus, there arises no problem in use but in the case of considering fuel efficiency improving effect, the viscosity is not preferable.

Figure 2A:
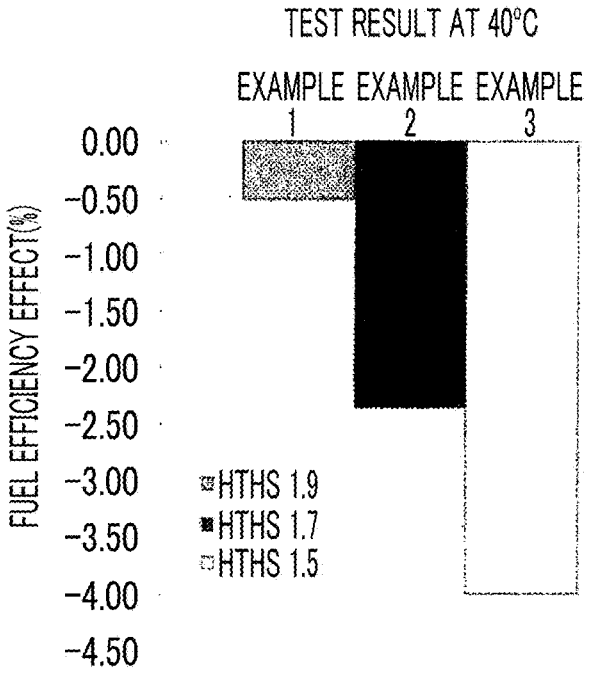
FIGS. 2A and 2B are graphs showing results of measuring the fuel consumption reduction effect (friction reduction effect) of lubricating oil compositions for internal combustion engines obtained in Examples.
Figure 2B:
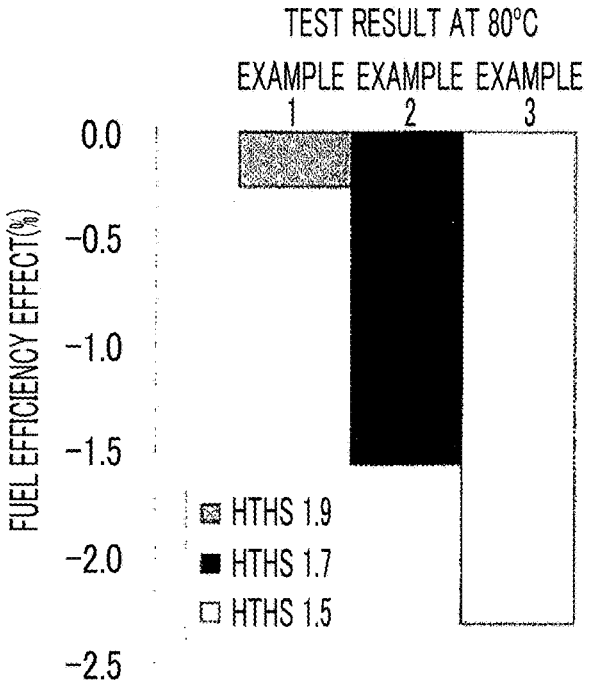

FIGS. 2A and 2B are graphs showing the fuel consumption reduction effect (%) of the lubricating oil compositions for internal combustion engines of Examples 1 to 3. The fuel consumption reduction effect (%) of the lubricating oil compositions for internal combustion engines of Examples 1 to 3 was measured at 40° C. and 80° C. As shown in FIGS. 2A and 2B, it is found that as the value of the high temperature shear viscosity (HTHS viscosity) decreases, higher fuel consumption reduction effect can be obtained.

Figure 3:
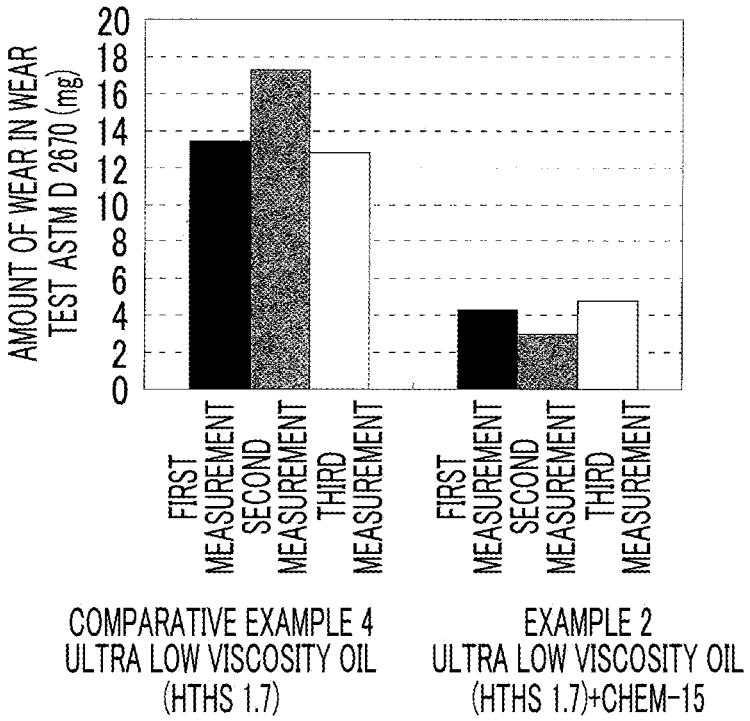
FIG. 3 is a graph showing results of measuring the amount of wear of engine components when lubricating oil compositions for internal combustion engines obtained in Examples and Comparative Examples are used.

FIG. 3 is a graph showing the amount of wear (mg) of Example 2 and Comparative Example 4. As shown in FIG. 3, it is found that in Example 2, the amount of wear is reduced and a lubricating oil composition for internal combustion engines having excellent wear resistance can be obtained compared to Comparative Example 4.

Figure 4:
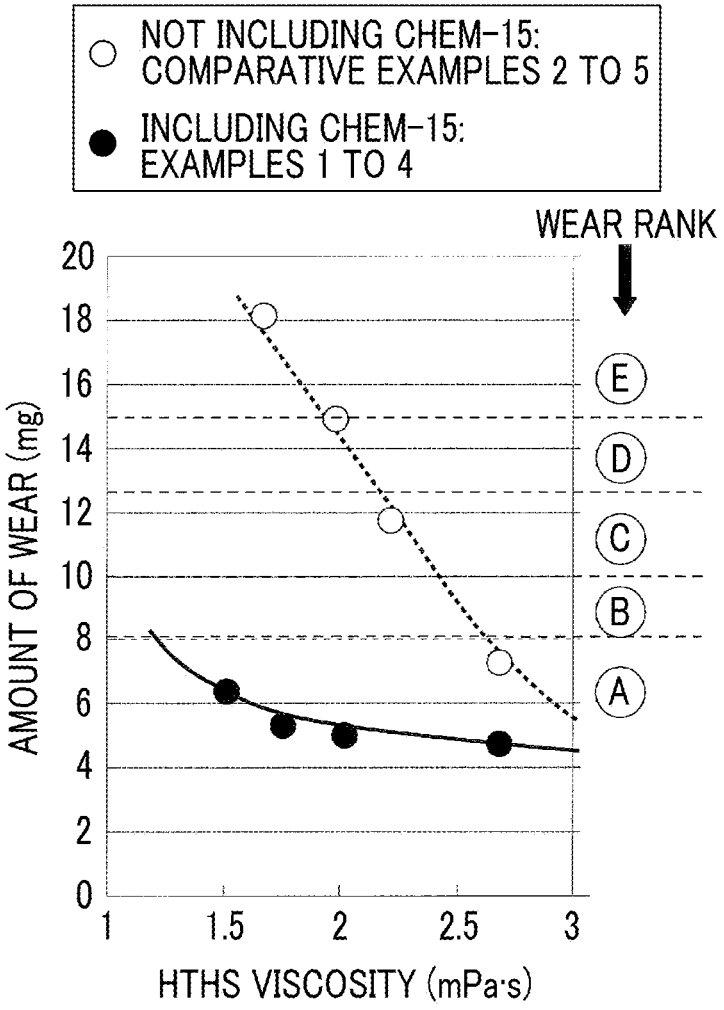
FIG. 4 is a graph showing results of measuring the amount of wear of engine components when lubricating oil compositions for internal combustion engines having various HTHS viscosity obtained in Examples and Comparative Examples are used.

FIG. 4 is a graph showing the amount of wear (mg) of the lubricating oil compositions for internal combustion engines in Examples 1 to 4 and Comparative Examples 2 to 5. As seen from FIG. 4, irrespective of the high temperature shear viscosity (HTHS viscosity) of the base oil, the amount of wear is small. Particularly, it is found that even in the case in which the high temperature high shear viscosity (HTHS viscosity) is low, the amount of wear is small.

Further, although not shown in drawings, when the addition ratio of the complex polyester mixture (Chem-15) is changed in Examples, it was found that the amount of wear was remarkably reduced at the time when an addition ratio of the complex polyester mixture (Chem-15) was 0.25% by mass or more. Specifically, the estimated amount of wear (mg) at the time when the addition ratio of the complex polyester mixture (Chem-15) was 0.25% by mass was 9 mg.

As long as the estimated amount of wear is 9 mg or less, the amount of wear is in a more preferable range as a lubricating oil composition for internal combustion engines. On the other hand, when the addition ratio of the complex polyester mixture (Chem-15) is 1% by mass or more, a remarkable reduction in the amount of wear cannot be observed. Therefore, it was found that the addition ratio of the complex polyester mixture (Chem-15) of 0.25% by mass to 1% by mass was particularly preferable range.

Further, although not shown in the drawing, the wear resistance is likely to be affected by oil solubility. As described above, the amount of the complex polyester mixture (Chem-15) to be added is preferably 0.25% or more, and the oil solubility is likely to become satisfactory. Specifically, in the complex polyester mixtures used in Examples 2, 8, and 13, both the wear resistance and the oil solubility are preferable. It can be confirmed that the oil solubility of the complex polyester mixtures (Chem-15) and (Chem-16) in the paraffin-based base oil is 100% and the complex polyester mixtures are completely compatible materials.

INDUSTRIAL APPLICABILITY

According to the present invention, it is possible to obtain a lubricating oil composition for internal combustion engines of passenger and commercial four-wheeled vehicles which can exhibit excellent fuel efficiency performance and abrasion resistance reliability. In addition, since the lubricating oil composition for internal combustion engines of the present invention has high abrasion resistance reliability, the degree of freedom in engine design can be remarkably improved and thus the present invention has high industrial applicability.

What is claimed is:

1. A lubricating oil composition for internal combustion engines of passenger and commercial four-wheeled vehicles comprising:

a base oil; and a complex polyester mixture, wherein the base oil includes at least one of poly-α-olefin, an ester-based base oil, or a partially hydrogenated mineral oil, the complex polyester mixture includes a polyester obtained by condensing a polyhydric alcohol having at least two hydroxyl groups, a polycarboxylic acid including at least two carboxyl groups, and a monohydric alcohol having at least one oxyalkylene group, the content of the complex polyester mixture is 0.01% by mass to 2.5% by mass with respect to the total mass of the lubricating oil composition for internal combustion engines, the HTHS viscosity of the lubricating oil composition for internal combustion engines, which is high-temperature shear viscosity at 150° C., is 1.0 mPa·s to 2.6 mPa·s, the NOACK evaporation amount is 40% or less, and the monohydric alcohol is represented by the following Formula (1-1):

Formula (1-1)

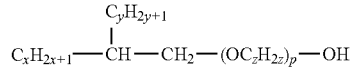

wherein, in the Formula (1-1), x represents an integer of 4 to 9, y represents an integer of 2 to 9, z represents 2 or 3, p represents 1 or 2, and in the case in which p is 2 or greater, p-($OC_z H_{2z}$)-s may be the same or different from each other.

2. The lubricating oil composition for internal combustion engines according to claim 1, wherein the number of carbon atoms in the polycarboxylic acid is 7 or more.

3. The lubricating oil composition for internal combustion engines according to claim 1, wherein the polyhydric alcohol includes three or more hydroxyl groups.

4. The lubricating oil composition for internal combustion engines according to claim 1, wherein the polyhydric alcohol is selected from pentaerythritol, trimethylolpropane, glycerin and dipentaerythritol.

5. The lubricating oil composition for internal combustion engines according to claim 1, wherein the number of carbon atoms in the polycarboxylic acid is 24 to 54.

6. The lubricating oil composition for internal combustion engines according to claim 1, wherein the polyester is obtained by mixing the polycarboxylic acid, the polyhydric alcohol, and the monohydric alcohol such that the molar ratio of the polycarboxylic acid is 1 to 5 and the molar ratio of the monohydric alcohol is 0.5 to 5 with respect to the polyhydric alcohol and condensing the mixture.

7. The lubricating oil composition for internal combustion engines according to claim 1, wherein the polyester is obtained by mixing the polycarboxylic acid, the polyhydric alcohol, and the monohydric alcohol such that the molar ratio of the polycarboxylic acid is 2.2 to 5 and the molar ratio of the monohydric alcohol is 2.5 to 5 with respect to the polyhydric alcohol and condensing the mixture.

8. The lubricating oil composition for internal combustion engines according to claim 1, further comprising:

an organic metal compound, wherein the content of the organic metal compound is 0.001% by mass to 0.4% by mass with respect to the lubricating oil composition for internal combustion engines.

9. The lubricating oil composition for internal combustion engines according to claim 1, wherein the base oil includes at least a partially hydrogenated mineral oil.

10. The lubricating oil composition for internal combustion engines according to claim 1, further comprising an organic metal compound.

11. The lubricating oil composition for internal combustion engines according to claim 10, wherein the organic metal compound is at least one selected from organic molybdenum compounds and organic zinc compounds.

12. The lubricating oil composition for internal combustion engines according to claim 10, wherein the organic metal compound includes organic molybdenum compounds and organic zinc compounds.

* * * * *